US007580537B2

(12) United States Patent
Urso et al.

(10) Patent No.: US 7,580,537 B2
(45) **Date of Patent: *Aug. 25, 2009**

(54) SEALING RETAINER FOR EXTENDED WEAR HEARING DEVICES

(75) Inventors: Richard Carl Urso, Dublin, CA (US); Adnan Shennib, Fremont, CA (US); Greg Anderson, Fremont, CA (US); Sunder Ram, San Jose, CA (US); Robert Schindler, San Francisco, CA (US); Ian Day, Fremont, CA (US); James Buckley, San Jose, CA (US); John Sadler, Belmont, CA (US); Alex Tilson, Burlingame, CA (US)

(73) Assignee: InSound Medical, Inc., Newark, CA (US)

( * ) Notice: Subject to any disclaimer, the term of this patent is extended or adjusted under 35 U.S.C. 154(b) by 251 days.

This patent is subject to a terminal disclaimer.

(21) Appl. No.: 11/452,610

(22) Filed: Jun. 13, 2006

(65) Prior Publication Data

US 2006/0291682 A1 Dec. 28, 2006

Related U.S. Application Data

(63) Continuation-in-part of application No. 11/238,154, filed on Sep. 27, 2005, and a continuation-in-part of application No. 10/693,628, filed on Oct. 25, 2003, now Pat. No. 7,310,426, which is a continuation-in-part of application No. 10/052,199, filed on Jan. 16, 2002, now Pat. No. 7,215,789, which is a continuation of application No. 09/327,717, filed on Jun. 8, 1999, now Pat. No. 6,473,513, which is a continuation of application No. 09/199,669, filed on Nov. 25, 1998, now Pat. No. 6,940,988.

(51) Int. Cl.
*H04R 25/00* (2006.01)

(52) U.S. Cl. ..... 381/322; 381/328

(58) Field of Classification Search ..... 381/60, 381/312, 315, 322–330, 380; 181/129, 130, 181/135; 600/25; 607/56, 57
See application file for complete search history.

(56) References Cited

U.S. PATENT DOCUMENTS 4,817,609 A 4/1989 Perkins et al.

(Continued)

OTHER PUBLICATIONS

Ballachandra, The Human Ear Canal, Singular Publishing, 1995, pp. 195.
International Preliminary Report on Patentability of PCT Application No. PCT/US2006/037971, mailed Apr. 1, 2008, 9 pages total.
International Search Report and Written Opinion of PCT Application No. PCT/US07/71005, mailed May 15, 2008, 12 pages total.
International Search Report and Written Opinion of PCT Application No. PCT/US07/70996, dated Sep. 10, 2008, 15 pages.

*Primary Examiner*—Brian Ensey
(74) *Attorney, Agent, or Firm*—Townsend and Townsend and Crew, LLP

(57) ABSTRACT

Embodiments of the invention provide seals for retaining hearing devices in the ear canal. An embodiment provides a seal for a hearing device comprising a curved shell having a wall and an opening at a shell apex portion. The shell defines a cavity for retention of a device component. The shell wall has a shape configured to distribute compressive forces applied to the shell perimeter such that when the shell is positioned in the canal, the shell wall dynamically conforms to changes in the shape of the canal to maintain an acoustical seal between a shell exterior surface and the canal walls. The shell can include an anti-microbial coating to produce a reduction in bacteria contacting the coating. Also, the shell wall can have a water vapor transmission rate to reduce moisture accumulation in the canal during periods of extended wear to reduce the incidence of infection and otitis.

57 Claims, 19 Drawing Sheets

U.S. PATENT DOCUMENTS

| | | | | |
|---|---|---|---|---|
| 5,201,007 | A | 4/1993 | Ward et al. | |
| 5,390,254 | A | 2/1995 | Adelman | |
| 5,401,920 | A | 3/1995 | Oliveira | |
| 5,572,954 | A | 11/1996 | Elkins | |
| 5,654,530 | A | 8/1997 | Sauer et al. | |
| 5,682,020 | A | 10/1997 | Oliveira | |
| 5,701,348 | A | 12/1997 | Shennib et al. | |
| 5,742,692 | A | 4/1998 | Garcia et al. | |
| 5,833,626 | A | 11/1998 | Leysieffer | |
| 5,887,070 | A | 3/1999 | Iseberg et al. | |
| 6,137,889 | A | 10/2000 | Shennib et al. | |
| 6,229,900 | B1 | 5/2001 | Leenen | |
| 6,359,993 | B2 | 3/2002 | Brimhall | |
| 6,473,511 | B1 | 10/2002 | Aceti et al. | |
| 6,473,513 | B1 | 10/2002 | Shennib et al. | |
| 6,671,381 | B1 | 12/2003 | Lux-Wellenhof | |
| 6,754,357 | B2 | 6/2004 | McIntoch et al. | |
| 6,940,988 | B1 | 9/2005 | Shennib et al. | |
| 7,016,512 | B1 * | 3/2006 | Feeley et al. | 381/324 |
| 7,130,437 | B2 | 10/2006 | Stonikas et al. | |
| 7,403,629 | B1 | 7/2008 | Aceti et al. | |
| 2004/0017922 | A1 * | 1/2004 | Bachler et al. | 381/322 |
| 2004/0161445 | A1 | 8/2004 | Bulk et al. | |
| 2006/0067551 | A1 * | 3/2006 | Cartwright et al. | 381/322 |

* cited by examiner

SEALING RETAINER FOR EXTENDED WEAR HEARING DEVICES

CROSS-REFERENCES TO RELATED APPLICATIONS

This application is a continuation-in-part of U.S. patent application Ser. No. 11/238,154, filed Sep. 27, 2005, titled "Sealing Retainer for Extended Wear Hearing Devices" which was a continuation-in-part of U.S. patent application Ser. No. 10/052,199, filed Jan. 16, 2002, now U.S. Pat. No. 7,215,789 titled "Disposable Extended Wear Canal Hearing Device" which was a continuation of U.S. patent application Ser. No. 09/327,717, filed Jun. 8, 1999, now U.S. Pat. No. 6,473,513, titled "Extended Wear Canal Hearing Device", both of which are fully incorporated herein by reference.

This application is also a continuation-in-part of U.S. patent application Ser. No. 10/693,628, filed Oct. 25, 2003, now U.S. Pat. No. 7,310,426, titled "Inconspicuous semi-permanent hearing device" which was a continuation of U.S. patent application Ser. No. 09/199,669, filed Nov. 25, 1998, now U.S. Pat. No 6,940,988, titled "Semi-Permanent Canal Hearing Device", both of which are fully incorporated herein by reference. This application is also related to concurrently filed U.S. patent application Ser. No. 11/453,279, entitled, "Sealing Retainer For Extended Wear Hearing Devices", the full disclosure of which is incorporated herein by reference.

BACKGROUND OF THE INVENTION

Field of the Invention

Embodiments of invention relate to hearing devices. More specifically embodiments of the invention relate to sealing retainers for improving the durability and comfort of continuous or extended wear hearing aids.

Since many hearing aid devices are adapted to be fit into the ear canal, a brief description of the anatomy of the ear canal will now be presented for purposes of illustration. While the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

A cross-sectional view of the typical ear canal 10 (FIG. 2) reveals generally an oval shape pointed inferiorly (lower side). The long diameter ($D_L$) is along the vertical axis and the short diameter ($D_S$) is along the horizontal axis. These dimensions vary among individuals.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human Ear Canal, Singular Publishing, 1995, pp. 195). There is no cerumen production or hair in the bony part of the ear canal.

The ear canal 10 terminates medially with the tympanic membrane 18. Lateral of and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal.

First generation hearing devices were primarily of the Behind-The-Ear (BTE) type. However, they have been largely replaced by In-The-Canal (ITC) hearing devices are of which there are three types. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. These devices fit deep within the ear canal and can be essentially hidden from view from the outside.

In addition to the obvious cosmetic advantages CIC hearing devices provide, they also have several performance advantages that larger, externally mounted devices do not offer. Placing the hearing device deep within the ear canal and proximate to the tympanic membrane (ear drum) improves the frequency response of the device, reduces the occurrence of the occlusion effect, and improves overall sound fidelity.

However, despite their advantages, many CIC hearing devices continue to have performance issues including retention in the ear canal and acoustic feedback. Seals incorporated onto CIC devices have been used to prevent oscillatory feedback which occurs when there is acoustic leakage from the output of the hearing aid receiver through a leakage path which reaches the hearing aid microphone causing sustained oscillation. This oscillatory feedback is manifested by "whistling" or "squealing" which is bothersome and interferes with communication. Oscillatory feedback is typically alleviated by tightly occluding (sealing) the ear canal between the microphone and the receiver. However, complete sealing can prove difficult, for example, jaw motion of the user may cause deformation of the seal and thus acoustical leakage. During jaw movement the fleshy part moves relative to the bony part so that the hearing aid and/or seal are pressed to one side of the ear canal and a gap may be formed at the other side giving rise to an acoustical leakage path causing feedback. The seal(s) can buckle due to non uniform distribution of forces on the seal and/or when the ear canal deforms resulting in an acoustical leak.

Also, the seal or hearing aid housing may not be sufficiently biocompatible or exert too much force on the ear canal epithelium resulting in one or more of irritation, inflammation, ulceration and/or infection of the epithelium and ear canal as well as thinning of the epithelium. Further, long term effects of wearing aids hearing aid are known to include chronic inflammation and atrophy of the canal epithelium and a gradual remodeling of the bony canal. Besides being uncomfortable, such conditions can require the hearing device to be removed and may actually inhibit or prevent the patient from wearing the hearing aid for extended periods of time until the canal heals. Accordingly, there is a need for a biocompatible seal for a hearing aid to comfortably retain the device in the ear canal on a continuous wear basis while reducing acoustic feedback and the risk of infection and skin ulceration.

BRIEF SUMMARY OF THE INVENTION

Various embodiments of the invention provide systems and assemblies for improving the long term reliability and wearability of extended wear hearing devices including completely in the canal (CIC) hearing aids. Many embodiments provide a seal for improving one or more of the comfort, fit, biocompatibility and performance of CIC hearing aids worn for extended periods including three to six months or longer. Specific embodiments provide a sealing retainer that stabilizes the hearing aid in the ear canal while maintaining the health and integrity of the ear canal including the canal epithelium. Also particular embodiments provide two or more sealing retainers for retaining the hearing aid or other hearing device in the ear canal. In one embodiment, the seal can comprise a first seal configured to be mounted over a first hearing device component, such as a microphone assembly, and a second seal configured to be mounted over a second hearing device component, such as a receiver assembly.

Many embodiments provide a sealing retainer for a CIC hearing aid comprising a hollow curved compliant shell having a centrally placed opening for holding the hearing aid and inner walls having a scalloped or convoluted shape. The shell has a dome like shape configured to fit in the ear canal that can include an oval cross section and a medially decreasing taper with respect to a longitudinal axis of the shell. The shell can also include a vent and a sleeve section positioned at an apex of the shell that fits over portions of the body of the hearing aid. These and related embodiments of the retainer can be configured to perform several functions. First, the retainer can be configured to retain and center the hearing aid within the ear canal for long term wear. Retention can be achieved by constructing the retainer from an elastomeric material, such as an elastomeric foam, that is conformable to the shape of the canal and exerts a distributed spring force on the ear canal to hold the retainer in place. Retention in the ear canal can also be facilitated by the use of a coating that enhances adhesion between the seal and the canal and/or promotes the in growth of fibrils of endothelial tissue known as asparagines to a selected depth into the coating so as to mechanically retain the seal in the ear canal.

Many embodiments can be configured to not only retain a hearing aid in the ear canal, but do so in the bony portion of the ear canal. This serves to stabilize the hearing aid in the canal by reducing or dampening movement of the hearing aid in the canal by mechanically coupling the hearing aid to a portion of the canal which itself does not readily move. Such stabilization can improve sound quality by reducing motion artifact of the hearing aid that may occur during rapid motion from activities such as sports, etc.

The retainer can also be configured to maintain the health and integrity of the ear canal including the epithelium. That is, the retainer is configured to be atraumatic to the canal epithelium and prevent or minimize infection and inflammation of the epithelium. In various embodiments, this can be accomplished by the use of biocompatible materials and configuring the retainer to exert a force on the epithelium less than the venous return pressure of the epithelial vasculature. The retainer can include various means for conferring infection resistance which also provides for maintenance of the health and integrity of the ear canal. For example, the retainer can be vapor permeable (e.g., air and water vapor) and/or vented to reduce humidity and moisture accumulation within the ear canal tending to cause infection. Infection resistance can be further enhanced through the incorporation of antimicrobial agents into the retainer surface and/or retainer coating.

Also, the retainer can be configured to provide sufficient acoustical sealing to prevent or minimize feedback resulting from acoustical leakages to the hearing aid microphone from the speaker assembly including when the seal is deformed, for example, due to compression of the ear canal from movement of the head etc. The seal can also be configured to produce a selectable offset angle between receiver and the microphone assembly to accommodate the shape of the ear canal and facilitate placement of the hearing aid in the canal. Finally, the seal can be sized and otherwise configured to position and retain the speaker assembly of the hearing device close to the tympanic membrane so as to minimize the volume between the speaker assembly and the tympanic membrane (i.e., the residual volume) and so reduce occlusion effects described herein. In one embodiment, the shell can be sized to be positioned in a bony portion of the canal such that the residual volume is less than about 0.5 cc.

Many embodiments of the retainer include an inner wall having a scalloped or convoluted shape. The scallops can be configured to function as hinged elements which collectively impart a selectable amount of stiffness and conformability to the seal. The scalloped or convoluted shape can be configured to perform a number of functions to facilitate use of the hearing aid when positioned in the ear canal including positioning in the bony portion of the canal. First, they can be configured to uniformly distribute the forces exerted by the ear canal so as to have substantially continuous contact between the seal and the ear canal to prevent acoustical gaps. That is, there is little or no buckling or other pleated deformation of the seal resulting in gaps between the seal and the canal wall. The scallops can also be configured to uniformly distribute the spring forces applied by the retainer to the inner surface of the ear canal to retain the hearing aid in the ear canal and at the same time not to exceed the capillary venous return pressure of the vasculature of the epithelial layer of the inner layer of the ear canal.

Also as discussed above, in many embodiments, the retainer can include a coating used to facilitate retention of the seal in the ear canal as well as perform several other functions. The retention function of the coating can be accomplished by several means. First through the use of an adhesive coating configured to adhere to the inner surface of the ear canal. Also, the coating can be configured to promote the in-growth of fibrils of endothelial tissue known as asparagines to a selected depth into the coating so as to mechanically retain the seal in the ear canal. In addition to performing a retention function, the coating can be configured to have acoustical attenuation properties so as to increase the acoustical attenuation of the seal. In specific embodiments, the coating can be configured to increase the acoustical attenuation of the seal by about 5 to 10 decibels or more. Finally, the coating can also be a hydrophobic coating configured to prevent wetting of the retaining seal and perform a sealing function to prevent liquid water from entering into and saturating the retaining seal.

One embodiment provides a seal for retaining a continuous wear hearing device within the bony portion of an ear canal comprising a curved shell having a wall and an opening at an apex portion of the shell. The shell can have a dome-like or hemispherical shape that defines a cavity for retention of a hearing device component such as a hearing aid portion of hearing aid such as the microphone assembly. At least a portion of the shell comprises a resilient material having sound attenuating properties. An interior surface of a shell wall has a scalloped or other shape configured to distribute compressive forces applied to the shell perimeter such that when the shell is positioned in the ear canal, the shell wall conforms to the shape of the ear canal to maintain an acoustical seal between an exterior surface of the shell and the walls of the ear canal. Further, the shape is such that the shell wall dynamically conforms to changes in the shape of the canal such as might occur during head movement, chewing etc. When a force is applied to the shell (e.g., by the ear canal), the shell wall conforms to the shape of the ear canal to prevent an acoustical leak between the exterior surface of the shell and walls of the ear canal. The scalloped shape can be configured to produce a substantially constant amount of inward deformation of a shell wall independent of a force application point on a shell perimeter. At least a portion of the shell can include a coating configured to retain the seal in the ear canal and/or to promote asparagine growth into a selected depth into the coating to fastenly retain the seal in the ear canal. The shell can include a sleeve that fits over a portion of the hear aid and a vent positioned on the walls of the shell. The vent can function as one or both of a pressure relief vent or an occlusion relief vent. The shell wall has a gas permeability configured to prevent moisture accumulation in the canal and so reduce an incidence of otitis and/or ear canal infection when the seal is positioned in the canal as well as allow substantial equilibrium between a relative humidity in the portion of the ear canal occluded by the seal(s) and a relative humidity of ambient air outside the ear.

Another embodiment provides a seal for retaining a hearing device within a portion of the ear canal, comprising a curved shell having a wall and an opening at an apex portion of the shell. The shell wall defines a cavity for retention of a hearing device component with at least a portion of the shell comprising a resilient material having sound attenuating properties. The shell has a structure such that a force for removal of the seal from the ear canal is greater than a force for insertion of the seal into the canal. That structure can have an umbrella or a cup shape or other related shape. The structure can also be configured to act as a mechanical toggle when acted upon by a laterally applied force to the shell and can be configured to be put into compression when acted by such a force. Also, the structure can be configured to exert a constant frictional force against the canal wall during insertion into the ear canal. The seal can be configured to achieve selected levels of sound attenuation (e.g., three decibels) between a medial and lateral portion of the shell and can also include an anti-microbial coating configured to produce selected log reductions (e.g. a three log reduction) in colony forming units of bacteria contacting the coating. The shell can also be sized to be positioned in the bony portion of the canal to yield a residual volume of less than about 0.5 cc. The seal can also comprise a first and a second seal, configured to be positioned medially and laterally with respect to a bend in the ear canal so as to allow the hearing device to straddle a bend in the ear canal, e.g. a bend in the bony portion of the canal. Further, such embodiments can be configured to allow portions of the hearing device (e.g., the battery assembly and receiver assembly) to be maintained at an angular offset with respect to each other.

Another embodiment provides a method for wearing a hearing device, such as a CIC hearing aid, in the ear canal of a user. The hearing device includes an embodiment of the seal described herein, wherein the seal is configured to retain the in the ear canal with a force that does not exceed the capillary venous return pressure of a canal epithelial layer. The device is positioned at a location in the ear canal (e.g., the bony portion) and then can be worn in the canal on a continuous basis for extended periods of six months or longer without necrosis, ulceration or other irritation of the epithelial layer in that blood flow to or from the ear canal is not impeded by contact with or presence of the seal. The seal serves to retain the device in the canal during head or jaw motion and also substantially maintain an acoustical seal between the seal and the canal wall so as to prevent acoustical leaks causing feed back in the hearing device, such as those from the device microphone assembly to a speaker assembly.

Another embodiment provides a method for retaining a hearing device in the ear canal of a user that includes providing a hearing device having a retaining seal including a surface for inducing or promoting the in-growth of biological tissue from the walls of the ear canal. The hearing device can include a CIC hearing device. The hearing device is then positioned in at a location in the ear canal, for example, the bony portion of the ear canal. Desirably, the device is positioned deeply in the ear canal so as to minimize the residual volume, but can be positioned at any selected location in the canal. Growth of biological tissue into the surface of the seal is then induced so as to retain the hearing device at the location. The biological tissue typically include hair-like protrusions known as asparagines which grow a selected depth into the surface. In this way, the in-grown surface functions as a fastening surface and the asparagines as fasteners to retain the surface and thus the hearing device in the ear canal during extended periods of wear, for example, six months or longer. The fastening forces are strong enough to retain the device in the canal during the course of head and jaw movement or other body motions, but still allow the device to be easily removed.

BRIEF DESCRIPTION OF THE DRAWINGS

FIG. 6A shows an embodiment of the seal configured for a hearing aid having a symmetric cap, and FIG.6B shows an embodiment of the seal configured for a hearing aid having an asymmetric cap.

DETAILED DESCRIPTION OF THE INVENTION

Various embodiments of the invention provide systems, devices and assemblies for improving the durability, comfort and fit of CIC and other hearing devices worn deep in the ear canal on a long term basis. Specific embodiments provide a retaining seal for retaining a CIC hearing aid deep in the ear canal when worn on a long term basis.

Figure 1:
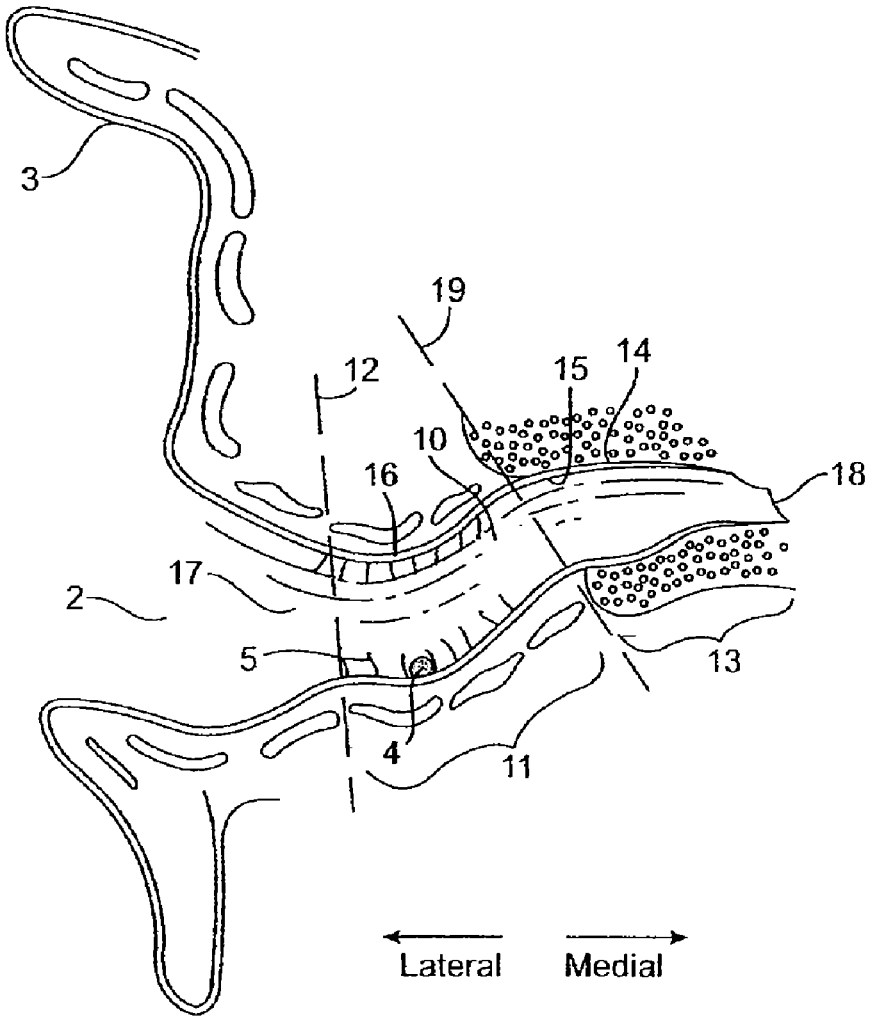
FIG. 1 is a side coronal view of the external ear canal.
Figure 2:
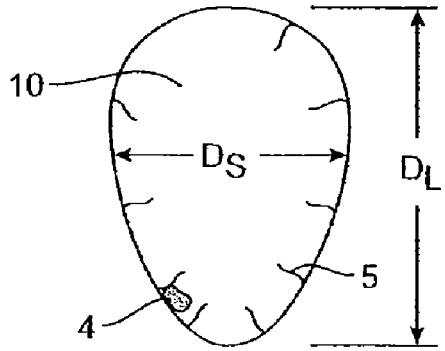
FIG. 2 is a cross-sectional view of the ear canal in the cartilaginous region.
Figure 3:
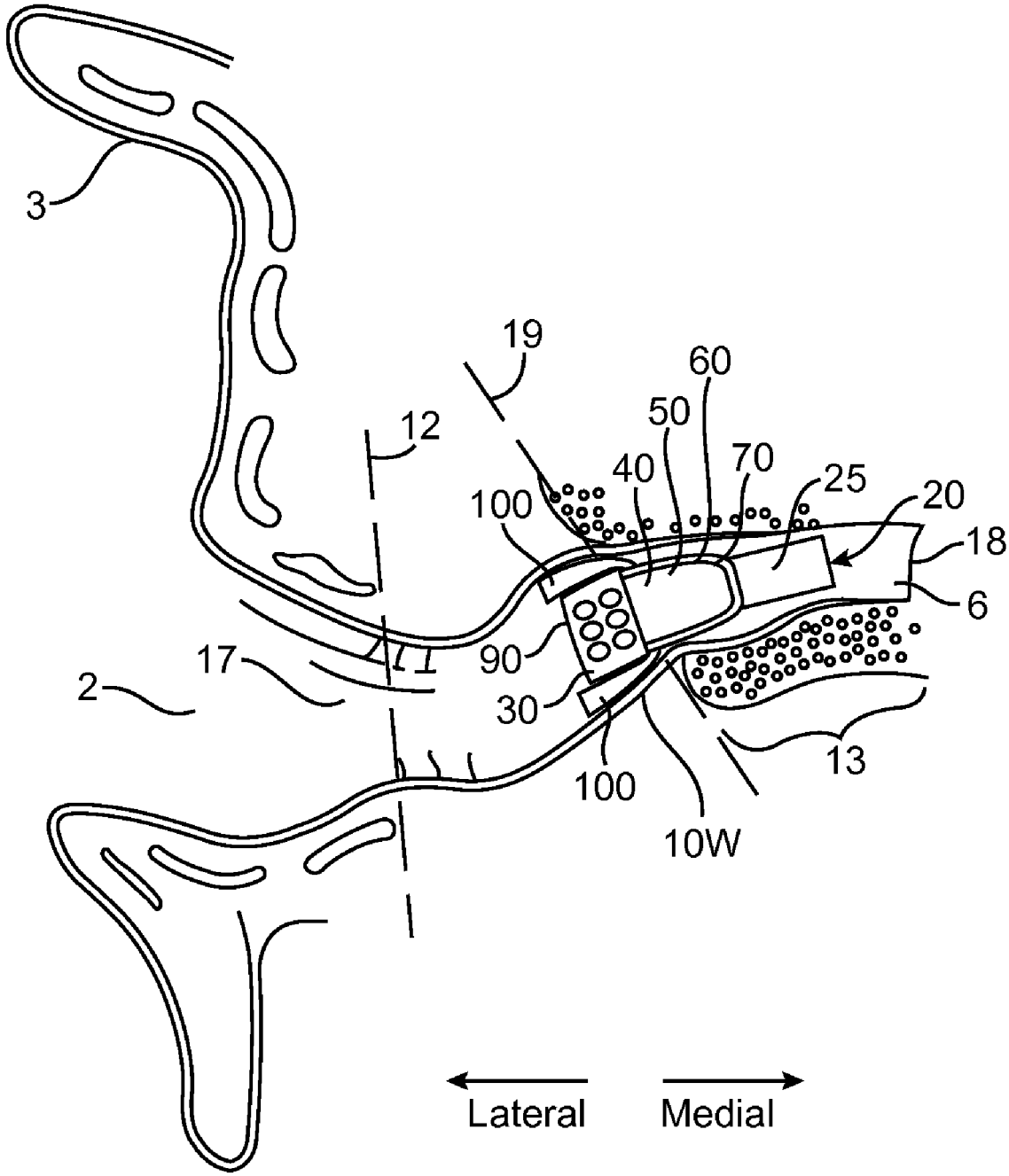
FIG. 3 is a lateral view illustrating an embodiment of a hearing aid device positioned in the bony portion of the ear canal.
Figure 4:
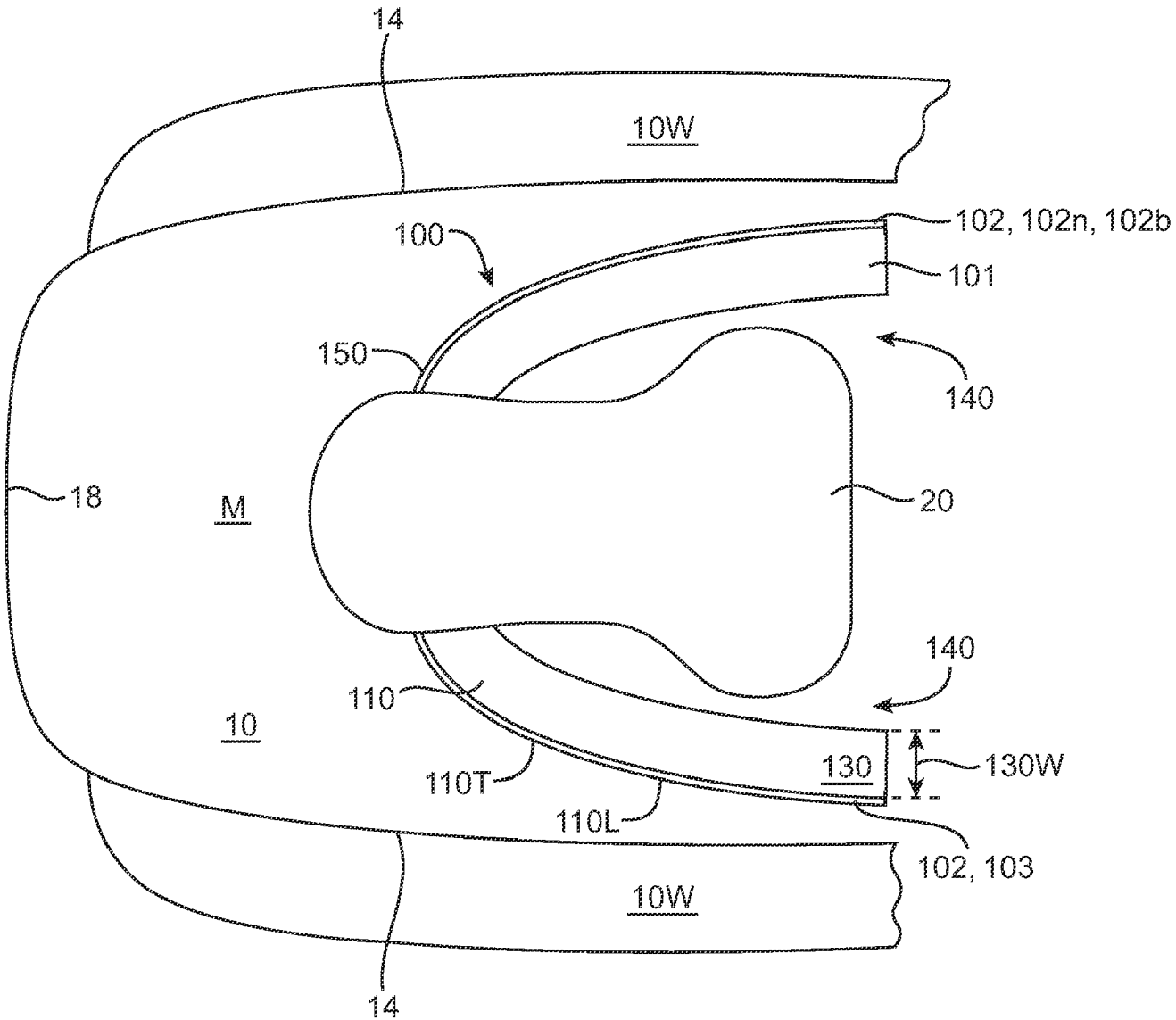
FIG. 4 is a side view illustrating an embodiment of the retainer having a shell and central opening.

Referring now to FIGS. 3-4, an embodiment of a CIC hearing aid device 20 configured for placement and use in ear canal 10 can include a receiver (speaker) assembly 25, a microphone assembly 30, a battery assembly 40, a cap assembly 90 and one or more sealing retainers 100 (also called seal 100) that can be coaxially positioned with respect to receiver assembly 25 and/or microphone assembly 30. Receiver assembly 25 is configured to supply acoustical signals received from the microphone assembly to a tympanic membrane of the wearer of the device. Battery assembly 40 includes a battery 50, and can also include a battery barrier 60 and a battery manifold 70. Preferably, device 20 is configured for placement and use in the bony region 13 of canal 10 so as to minimize acoustic occlusion effects due to residual volume 6 of air in the ear canal between device 20 and tympanic membrane 18. The occlusion effects are inversely proportion to residual volume 6; therefore, they can be minimized by placement of device 20 in the bony region 13 so as to minimize volume 6. Preferably, device 20 is also configured for extended wear in ear canal 10. In specific embodiments, hearing device 20 including a protective cap 90, can be configured to be worn continuously in the ear canal, including the bony portion, for 3 months, 6 months or even longer. Hearing device 20 can include various hearing aids known in the art including, without limitation, ITE, ITC and CIC hearing aids as well assemblies or components thereof e.g., the speaker assembly, etc. For ease of discussion, hearing device 20 will now be referred to as hearing aid 20 (which in many embodiments is a CIC hearing aid configured to be positioned in the bony portion of the ear canal); however, other types hearing devices described here and known in the art are equally applicable.

Figure 5A:
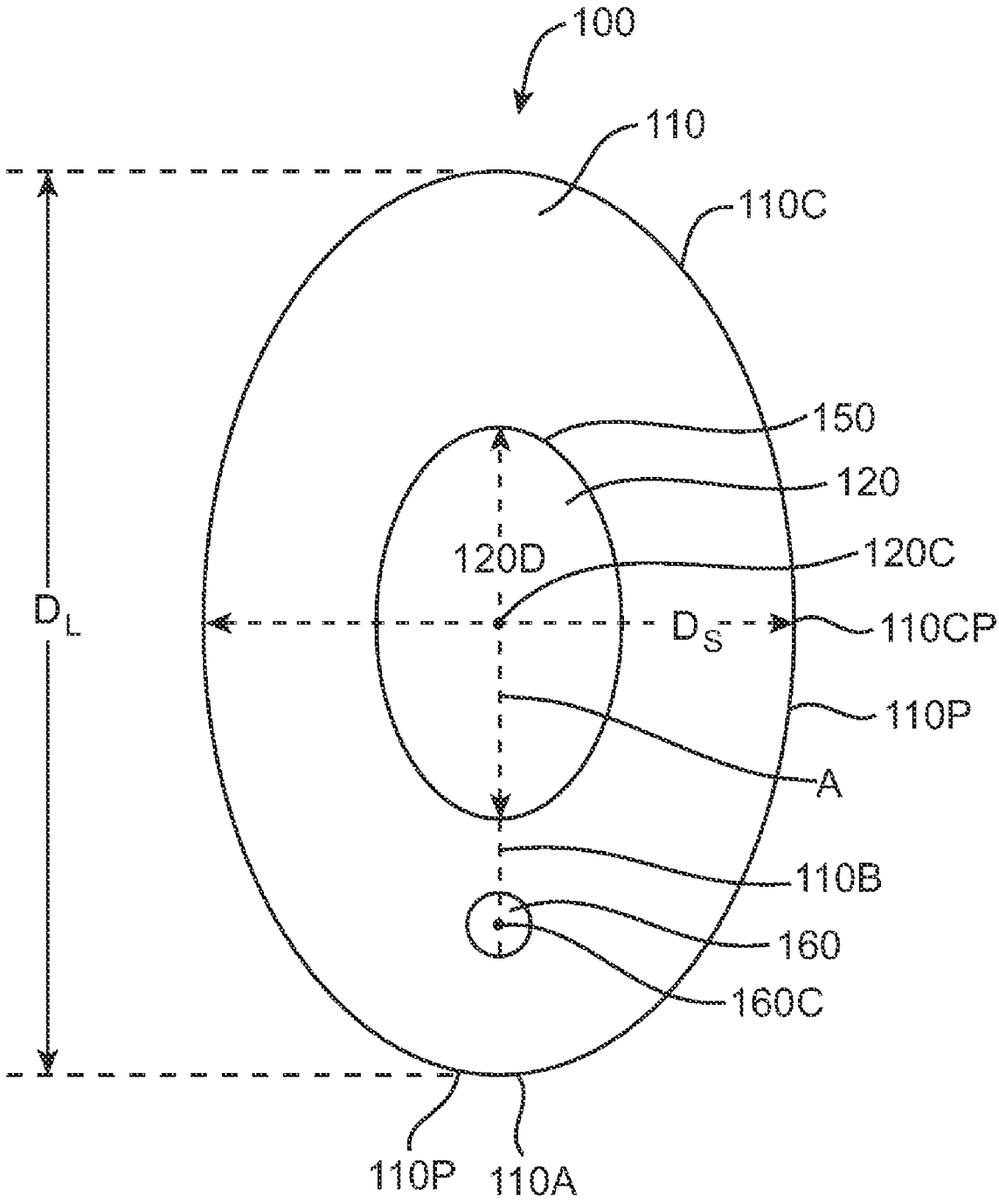
FIG. 5A is a top down view of an embodiment of the seal illustrating the position of the central opening on the apex of the shell and the position of a vent.
Figure 5B:
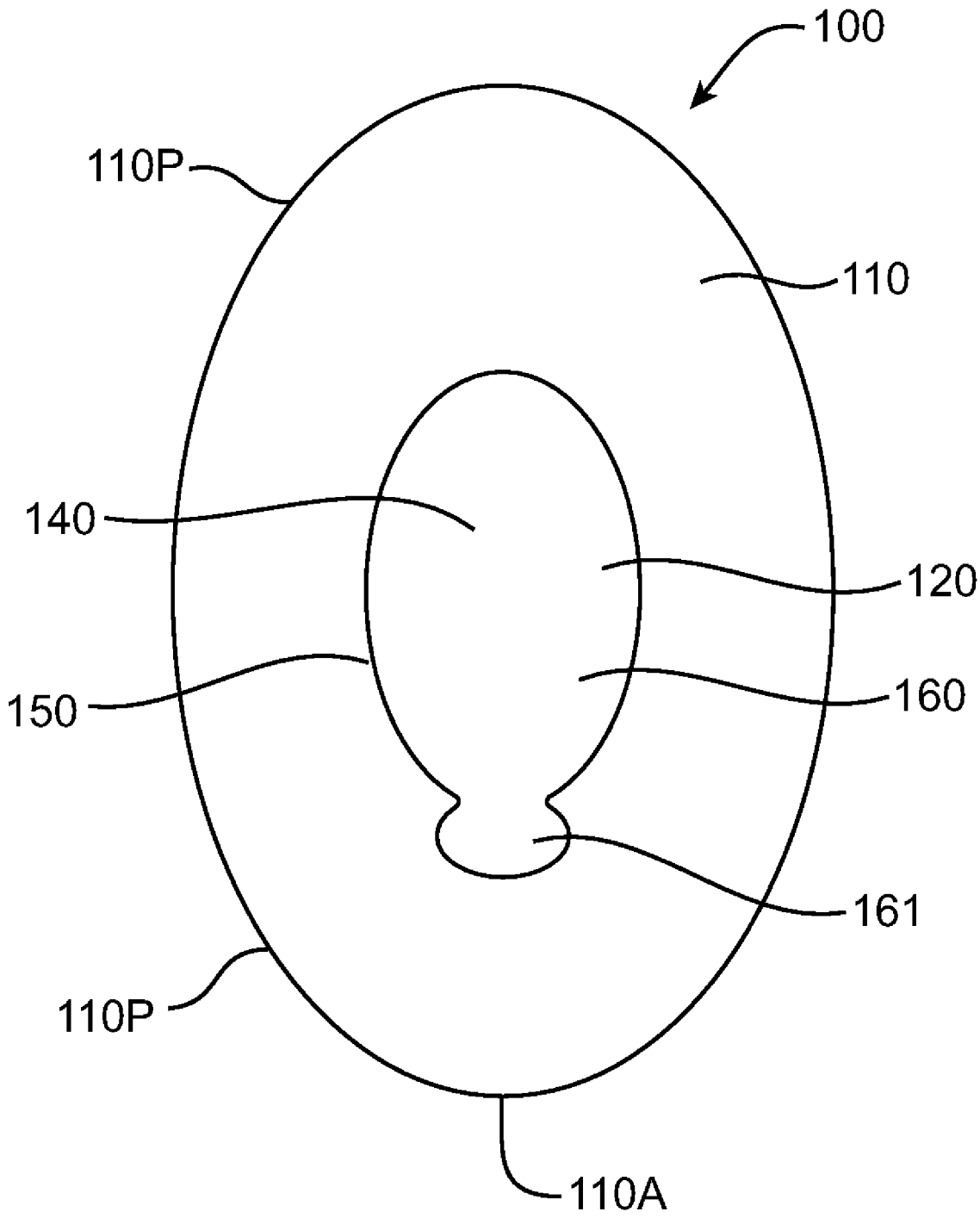
FIG. 5B is a top down view of an embodiment of the seal illustrating having a vent continuous with the central opening of the shell.

Referring now to FIGS. 4-6, a discussion will be presented of a retaining seal used for retaining a hearing device such as CIC hearing aid for continuous wear in the ear canal.

In various embodiments, retaining seal 100 includes a shell 110 having an opening 120, and walls 130 defining a cavity 140 for holding hearing device 20. In a preferred embodiment, at least one seal 100 is adapted to be positioned, as shown, substantially in the bony region 13 coaxially over the receiver assembly 25 (or other device portion) of hearing device 20. In other embodiments, the hearing device can include two seals 100 and shells 110 mounted over the device, one seal mounted over receiver assembly 25 (or other hearing device portion or component) and another over the battery assembly.40 (or other hearing device portion or component). Seal 100 is configured to provide the primary support for the device 20 within the ear canal 10. The seal is also configured to substantially surround portions of device 20 to protect it from contact with the walls 10W of the ear canal and thus exposure to cerumen, moisture and other contaminants. To that purpose, seal 100 can be configured to substantially conform to the shape of walls 10W of the ear canal including those in the bony region 13 and to maintain an acoustical seal between a seal surface and the ear canal and retain the device securely within the ear canal 10 including within bony portion 13. Further the seal can be configured to dynamically conform to changes in the shape of the canal (such as might occur during head movement, chewing etc) and still securely retain the device within the canal. The seal can be configured to be mounted concentrically or non-concentrically over the hearing device. Also the seals can be configured to be mounted over or to specific assemblies or portions of the hearing device, for example, the battery assembly, receiver assembly etc.

Opening 120 can be centrally placed (with respect to shell 110) at a medial apex 110A of the shell 110 and is configured to fit over and retain hearing aid 20 in the ear canal. Preferably, opening 120 is concentric with respect to shell 110 so as to facilitate the centering of hearing aid 20 in the ear canal. However, in other embodiments, it can be non-concentric. The shape of the opening 120 can be substantially circular or square but is preferably oval. The diameter 120D of opening can be in the range of 0.5 to 1.5 mm with a preferred embodiment of about 1 mm. Also opening 120 can be sized to be mounted over a specific assembly or portion of the hearing aid, e.g., the battery assembly, speaker assembly, etc. A vent 160 can be positioned near opening 120. In one embodiment, opening and vent centers 12*c* and 16*c* can be aligned on common axis A, which can be a line 110B bisecting shell 110. In another embodiment shown in FIG. 5B, vent 160 can actually be formed in the opening 120, such that opening 120 closes around hearing aid 20, but still leaves an opening 160 for venting. In another embodiment, the opening can include a cutout 161 for a vent-tube that is integral to hearing aid 20.

A discussion will now be presented of the shape and dimensions of the seal 100 and shell 110. The shape and dimension of the seal 100 and shell 110 are desirably selected to allow the seal to comfortably fit in the ear canal and retain a hearing device 20 in the canal for continuous or near continuous long-term wear, e.g., three to six months or longer. The axial length of the seal 100 can be in the range of about 5 to 20 mms, preferably between about 5 and 17 mms and more preferably between about 5 and 10 mms. The shell 110 has cross sectional and lateral profiles 110C and 110L one or both of which can be configured to approximately correspond to the corresponding profile of ear canal 10. These profiles can obtained using parametric data of the dimensions and shape of the ear canal for a patient population, sub-population or based on individual fittings and measurements of a given user. Also both cross sectional and lateral profiles 100C and 110L can be custom fit to the ear canal of the user by making a mold or cast of the ear canal using methods known in the art (e.g., elastomeric or paraffin molding techniques). In an exemplary embodiment, the shell 110 can have a dome like, or hemispherical shape having an apex 150 oriented toward a medial direction M of the ear canal 10. Other volumetric shapes that can be used for shell 110 can include without limitation, ovoid, rectangular, pyramidal, cylindrical or elongated cylindrical.

Also the shape of the shell can be sized for fitting over particular portions of the hearing device. In embodiments of hearing device 20 that include two seals, one seal can include a first shell sized for a first portion of the hearing device (e.g., the battery assembly) and another seal can include a another shell sized for a second portion of the hearing device (e.g., the receiver assembly). The shells and other portions of the seal can also be sized and shaped to perform the same or different function or to enhance a particular function. For example, in one embodiment, one seal can be configured to attenuate sound at a first frequency range and another seal at a second frequency range. In another embodiment, one seal can configured to primarily perform an acoustical attenuation or like function and the other a retaining or like function.

In various embodiments, profile 110C can be oval, elliptical or circular. In a preferred embodiment, profile 110C is oval and includes a short diameter $D_S$ and a long diameter $D_L$ which can be about 1.6 times that of the short diameter $D_S$ in order to approximately correspond to the profile of the ear canal. Also diameter $D_S$ can range from about 4.5 to 9 mm and diameter $D_L$ can range from about 7.25 to 15 mm. Also in this and related embodiments the thickness 130W of shell walls 130 can vary over the perimeter 110P of the shell. For example, the thickness can increase over the central portion 110 CP of the shell and decreased at apex's 110A. The varied thickness can be used to achieve desired mechanical properties of the shell, for example circumferentially constant deformation. In specific embodiments, wall thickness 130W can vary from about 0.048" at apex 110A to about 0.055" at the center portion 110CP. Also in specific embodiments, thickness 130W can vary based on a logarithmic, parabolic, second order or other equation with respect to perimeter 110P.

The lateral profile 110L of the shell is desirably configured to produce a comfortable fit in the ear canal while accounting for typical variations in the size and shape of the canal. In various embodiments, the lateral profile 110L can have a medially decreasing taper 110T including a constantly decreasing taper. The taper is desirably configured to produce a lateral profile 110L that approximately corresponds to the lateral profile of the ear canal.

Figure 6A:
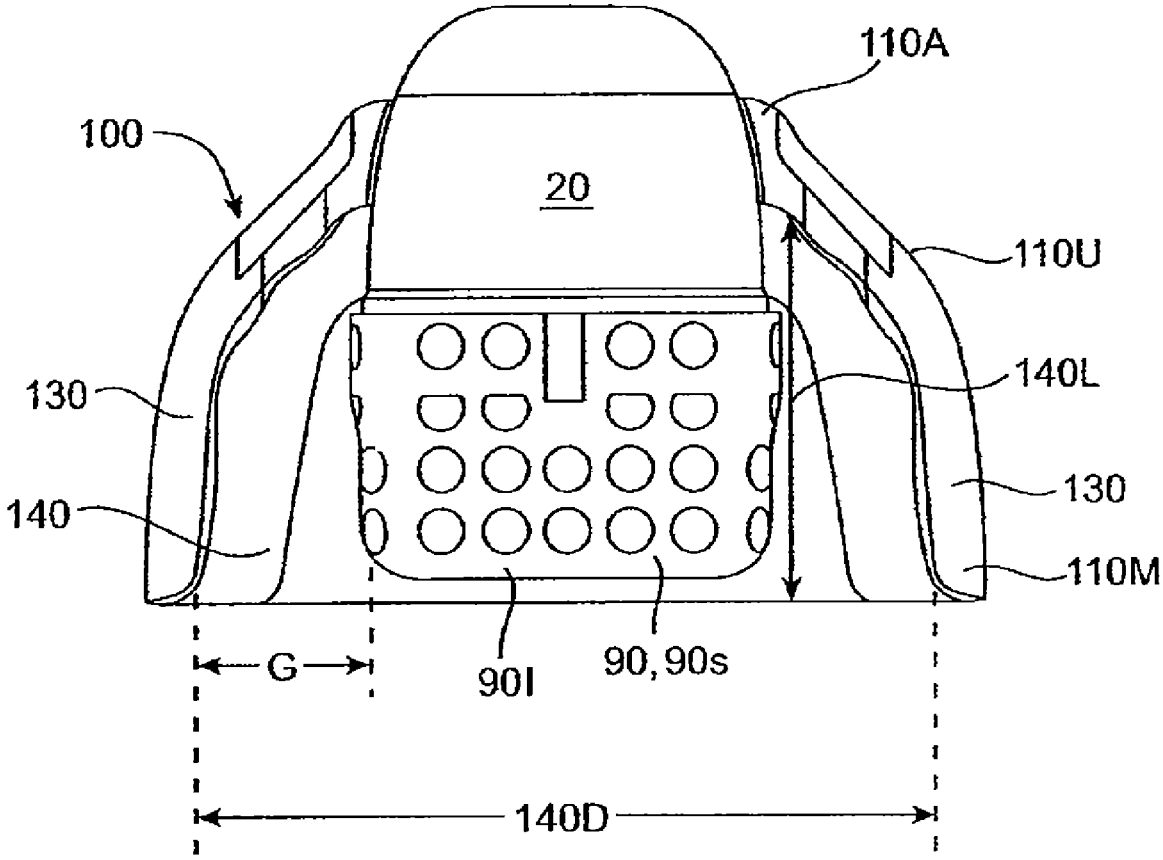
FIGS. 6A-6B are side phantom views illustrating embodiments of the seal positioned over a hearing device.
Figure 6B:
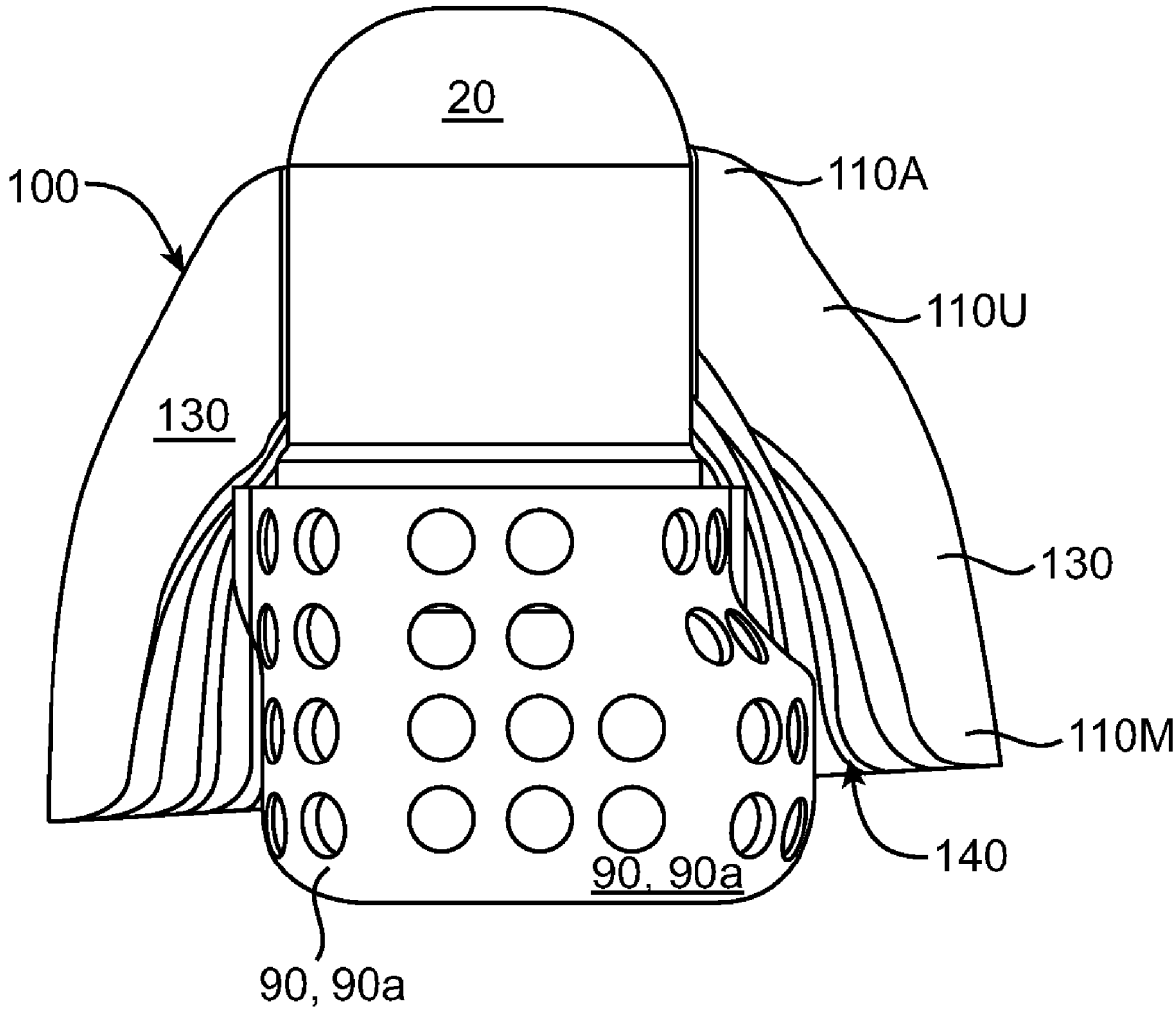

The dimensions of the seal 100 including cavity 130 also desirably selected to accommodate the size and shape of hearing device 20. In particular embodiments, the inner diameter 140D of cavity 140 can be selected to provide a gap G between hearing aid 20 and the shell walls 130 (see FIG. 6A) to provide for ventilation of the hearing aid as is discussed herein. The shell can be configured to provide a greater or lesser gap G depending upon the size and shape of the hearing aid (see FIG. 6A). In various embodiments, the shell can be configured to accommodate hearing aids having either a symmetrically aligned cap 90*s* as shown in FIG. 6A or an asymmetrically aligned cap 90*a* as shown in FIG. 6B. Also, the depth 140L of the cavity can be configured such that shell walls 130 laterally extend past the lateral face 90*l* of cap 90. Desirably, this amount of extension is no more than about 1 mm.

Figure 6C:
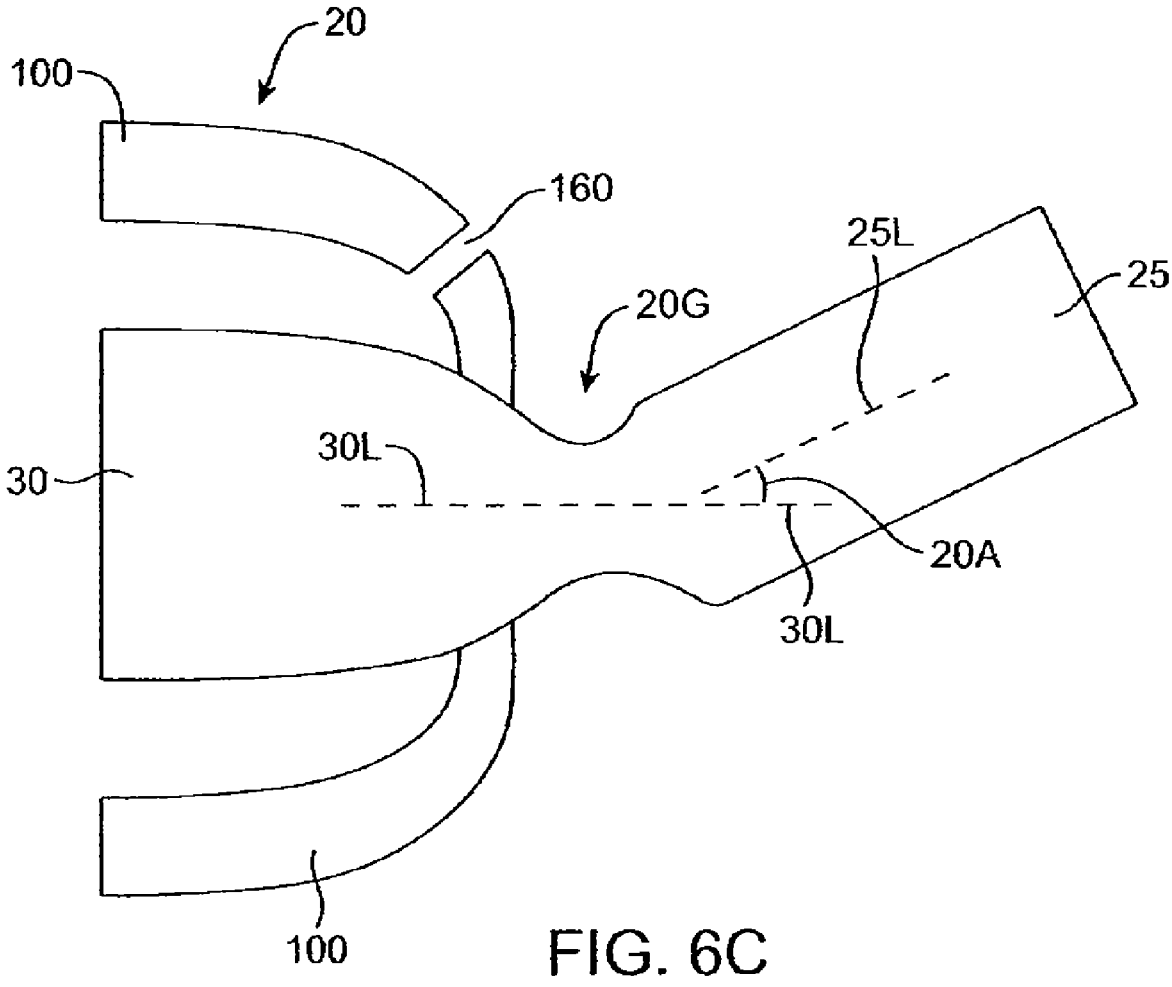
FIG. 6C is a lateral view illustrating an embodiment of the seal configured to hold hearing aid to produce a selectable offset angle between components of the hearing aid.

In various embodiments, in addition to having a shape configured to fit in the ear canal and retain a hearing aid therein, the seal can also be configured to retain one or more components of the hearing aid in a selectable position or angle relative to one another. As illustrated in FIG. 6C, in specific embodiments seal 100 can have a shape configured to retain microphone assembly 30 and receiver assembly 25 at a selectable angle known as offset angel 20A with respect the longitudinal axis of each assembly. The offset angel can also be achieved through the use of two or more seals comprising a multi-seal system as is described below. Offset angel 20A can range from about 10 to 40° with specific values of 15, 25 and 35°. In a preferred embodiment, the seal is configured to produce an offset angle 20A such that longitudinal axis 30L of microphone assembly 30 is oriented 15° anteriorly (i.e., with respect to the nose) with respect to the longitudinal axis 25L of speaker assembly 25. This angle gives hearing aid 20 a banana like shape which serves to accommodate the shape of the ear canal and so improve the fit of the hearing aid in the ear canal both during static and dynamic situations (e.g., during jaw movement). The offset angle 20A also produces a small gap 20G between the microphone assembly 30 and speaker assembly. Gap 20G facilitates the passage (e.g., via diffusion) of oxygen and water vapor around hearing aid 20 improving battery life for embodiments of the hearing aid 20 having metal air batteries and reducing moisture buildup in the ear canal. Also seal 100 can allow offset angle to adjust to account for movement in the ear canal occurring during chewing, talking and other jaw or head movements. Specifically, the seal can be configured to allow the microphone assemblies to bend and/or rotate with respect to each other due deformation of the ear canal from jaw and head motion.

In various embodiments, the shape and material properties of seal 100 and shell 110 can be configured to perform several functions. First, they can be configured to assist in the centering and retention of the hearing device 20 in ear canal 10. Centering can be achieved by configuring opening 120 to be substantially centrally positioned with respect to shell 110. Retention can be achieved by the configuring the seal to exert a spring force (though its shape and use of resilient materials known in the art, e.g., foam elastomers) on the ear canal combined with a surface 102 having a coefficient of friction and/or adhesive quality (through the use of a coating described herein) such that the ear canal exerts a frictional force on the surface of the seal tending to resist the seal being displaced (i.e., laterally displaced) from the ear canal, e.g., due to jaw or head motion, or even epithelial migration. Retention can further be enhanced through the use of a surface coating 103 configured to promote in growth of tissue asparagines so as to fastenly retain the seal in the ear canal. The shape and properties of the seal can also configured to promote the health of the ear canal by configuring the seal not to exert a force on the ear canal which exceeds the capillary venous return pressure of the canal endothelium (about 15 mmHg). This can be achieved though the selection of the dimensions and compliance (e.g., compression modulus) of the seal. In this way, the seal provides an atraumatic means for retaining a hearing device 20 in the ear canal.

In many embodiment the seal is configured to retain the device hearing in the bony portion 13 of the canal so that the hearing device does not migrate from that location (either laterally or laterally with respect to the head). These embodiments not only retain the hearing aid in that position but also minimize or reduce movement of the hearing aid within the canal e.g., for example due to head motion, chewing, swallowing, yawing etc. This reduced motion includes both lateral (e.g., side to side) an axial motion. This is achieved by utilizing the seal to mechanically couple the hearing aid to a portion of the canal which itself does not readily move or otherwise has reduced motion. Thus, in such embodiments, the seal serves not only a retaining function but also a movement dampening or stabilizing function. This stabilizing function in turn serves to improve the consistency of sound quality during use of the device by keeping the hearing aid in a substantially constant position with respect to incoming sounds to the microphone and outgoing amplified sounds from the receiver to the tympanic membrane. The cumulative effect being to prevent or minimize movement artifact of the hearing aid which can effect sound quality. Such embodiments can prove particular useful during periods of rapid head motion such as might occur during sports, dancing conversation, eating, etc. It can also improve the ability of the user to track sound location because when the user turns their head in response a sound the hearing aid stays substantially fixed within the ear canal and thus prevents or minimizes a movement artifact as might occur from the device shifting position in the ear canal when the wearer turns their head in response to a sound.

Also in many embodiments, the seal dimensions (e.g., thickness) and materials can be configured to allow sufficient vapor transmission (e.g., permeability) though the seal to prevent or minimize excessive moisture build up in the canal with seal in place. Suitable permeable materials can include without limitation, silicone, polyurethane and other elastomeric foams known in the art. In a preferred embodiment, the seal is fabricated from a vapor permeably polyurethane foam. Finally, the seal can be configured to provide sufficient acoustical attenuation to prevent or minimize acoustical feedback from the microphone assembly to the speaker assembly. This can be achieved through selection of one or more of the dimensions (e.g., thickness), shape and material properties of the seal. For example, higher levels of attenuation can be achieved through the use of one or both of denser materials or thicker wall dimensions. In various embodiments, seal 100 can be configured to provide between about 10 to 55 dB of acoustical attenuation between the lateral and medial portions of the seal over the range of human audible frequencies. In preferred embodiments, the seal is configured to provide greater than 18 dB of acoustical attenuation, more preferably 35 dB and even more preferably greater than 45 dB of acoustical attenuation.

In various embodiments, the acoustical attenuating properties of the seal can be further enhanced, particularly at selected frequencies, through the use of one or more coatings described herein such as a silicone coating. The coating can be configured to provide greater attenuation over a selected range of frequencies which can partially or fully overlap the attenuation frequency range of the seal or be at a different frequency range altogether. Thus in use, the coating provides a bi or even multi level frequency range of acoustical attenuation. The coating can also be configured (e.g., via control of viscosity, surface tension, etc) to fill in any pores or micro imperfections in the material of the seal than can serve as channels for acoustical leaks and, in this way, serve as a fault tolerant acoustical attenuation layer. Further, the coating can be configured to fill in such imperfections which develop after seal insertion and in this way the coating serves as self repairing acoustical attenuating layer which provides the seal with a self repairing acoustical attenuating property.

Figure 6D:
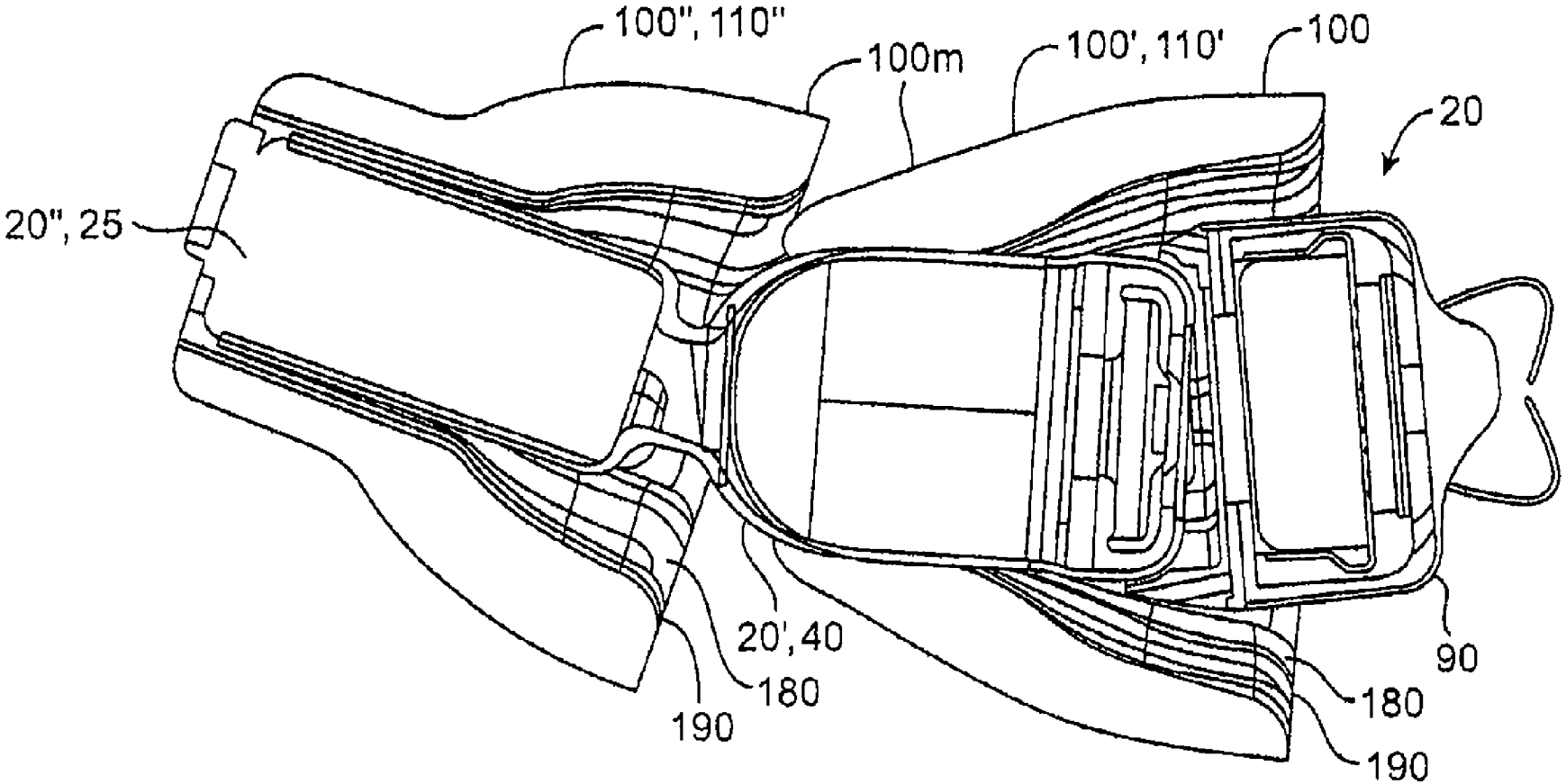
FIG. 6D is a lateral view illustrating an embodiment of the seal having a first and a second seal.

In various embodiments, seal 100 can comprise two or more seals so to form a multi-seal system 100*m*. FIG. 6D shows an embodiment of a multi-seal system 100*m* having a first seal 100' and a first shell 110' sized to fit a first portion 20' of the hearing device 20 and second seal 100" and a second shell 110" sized to fit over a second portion 20" of the hearing device. In one embodiment, the first portion 20' can be sized to fit over battery assembly 40 and the second portion receiver assembly 25. As described above, the shells and other portions of the seal can also be sized and shaped to perform the same or different function or to enhance or augment a particular function (e.g., acoustical attenuation). For example, in one embodiment, first seal 100' can be configured to attenuate sound at a first frequency range and second seal 100" at a second frequency range. These frequency ranges can span selected portions of the audible frequency range. Also, second seal 100" can configured to primarily perform an acoustical attenuation function and first seal 100' a retaining function or vice versa. To this end, the seals can have different dimensions and shapes. For example, first seal 100' can have a larger diameter as well as a greater number and different pattern 180 of scallops 190 than second seal 100". In this way, multi-seal 100*m* system provides a multi-functional seal for both retaining and improving the acoustical performance of a hearing device in the ear canal. First seal 100' and second seal 100" can also be configured (e.g., via size, shape, etc) to produce a selected offset angel as is described above.

In various embodiments, the seals of system 100*m* can also be adapted to fit in different parts of the ear canal 10. For example, second seal 100" can be adapted to be placed more medially in the canal closer to the tympanic membrane and first seal 100' more laterally. More specifically, first seal 100' can have a shape and spring force to center and retain hearing device first portion 20' (e.g., the battery assembly) in a first location in the ear canal and second seal 100" can have a shape and spring force to center and retain hearing device second portion 20" (e.g., the receiver assembly) in a second location in the ear canal. The use of different shapes and spring forces for the seals allows different shaped components of hearing device 20' to be centered and comfortably retained in different portions of the ear canal. It also provides for more points of contact and additive spring force for retaining the hearing device in the ear canal. In this way, the two seals of multi-seal system 100*m* provide a dual spring retention means for more securely and comfortably retaining a hearing device in the ear canal for periods of extended wear.

In various embodiments, first seal 100' and/or second seal 100" can be sized to be placed in the bony portion of the ear canal so as to minimize residual volume 6. In this case, the residual volume being the volume between the medial surface of the seal and the tympanic membrane. In particular embodiments, the seal can be sized to placed close enough to the tympanic membrane such the residual volume 6 is less than about 0.5 cc. In this way, the seal can used to improve acoustic performance of the hearing aid by enabling placement of the hearing aid to minimize residual volume and thus occlusion sounds. Placement of the seal and the hearing aid to a desired location in the bony portion of the canal can be facilitated by use of sizers or other measurement methods to measure the depth of a user's ear canal. In one embodiment, a sizer approximating the size of a seal can be employed in which the sizer has medial extending flexible member of a selected length which can be calibrated to a particular residual volume. The flexible member can be fabricated from flexible suture material known in the art. The user knows that the sizer has been inserted to the proper depth when the user feels the end of the flexible member contact the tympanic membrane. The physician can then record the depth of insertion and use that measurement for placement of the actual hearing aid. In other approaches for determining insertion depth and residual volume, the acoustical response of the hearing aid itself can be used with the hearing aid configured to signal the response to an external communications device and/or hearing aid evaluation device. The hearing aid can be configured to generate an acoustic signal which is used to measure the residual volume. Further description of such a device is found U.S. Pat. No. 7,016,504 which is fully incorporated by reference herein. In still other approaches the residual volume could be measured using ultrasound and other acoustical measurement and imaging techniques known in the art.

Figure 7:
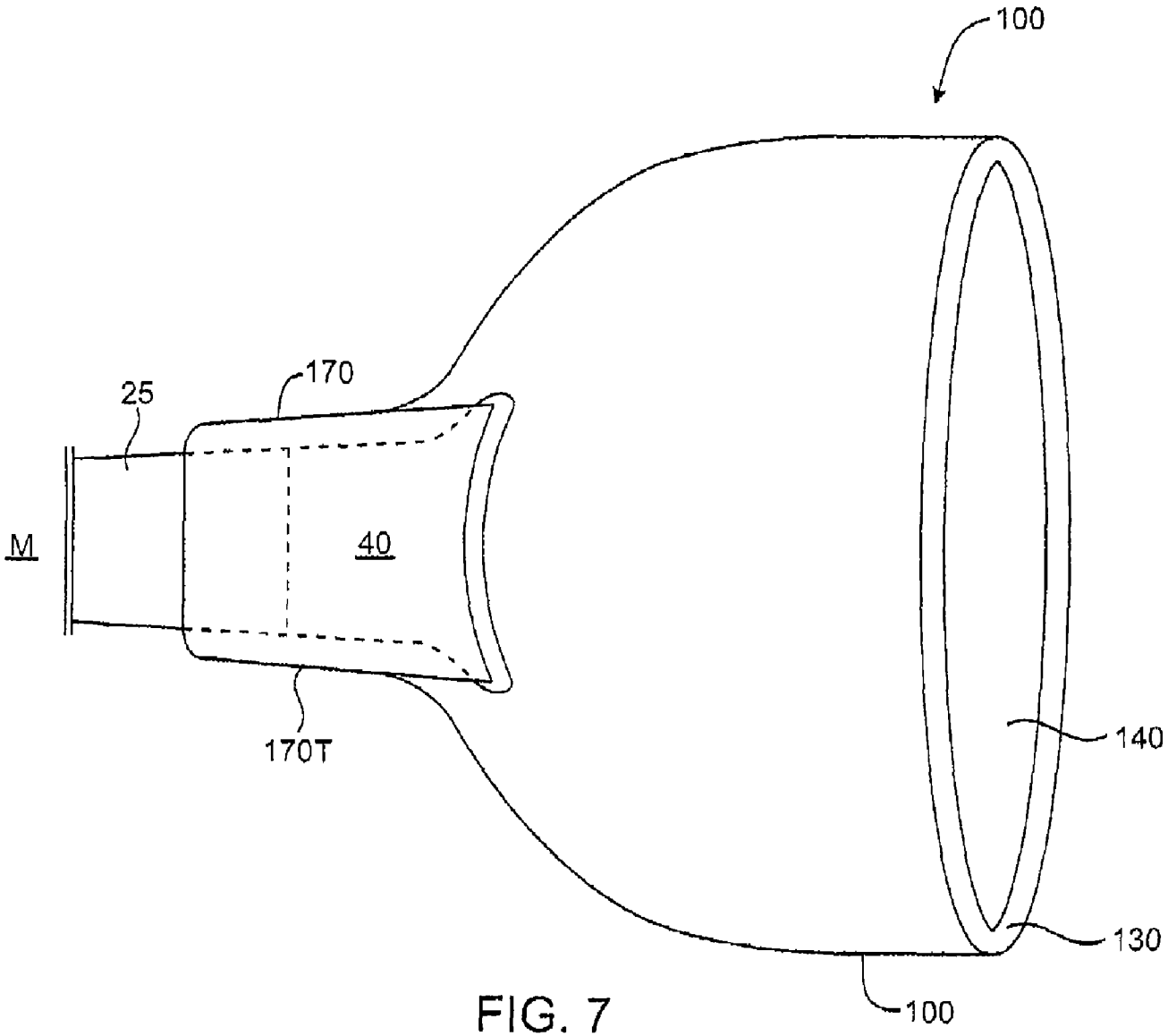
FIG. 7 is a side view which illustrates an embodiment of the shell having an adjoining sleeve.

As shown in FIG. 7, in various embodiments, the shell can be coupled to or otherwise include a sleeve or sleeve portion 170 that can be coupled to the shell 110 at opening 120. Sleeve 170 is configured to fit over portions of hearing device 20 such as battery assembly 40 and/or receiver assembly 25. The sleeve can be configured to protect these assemblies as well to help retain and/or stabilize the hearing device within the seal. The sleeve can be circular or oval in cross section and in a preferred embodiment has a rectangular cross section corresponding to the shape of an assembly of hearing aid 20 such as the speaker assembly. Also, all or a portion of the sleeve 170 can have a taper 170T. In one embodiment, taper 170T is a decreasing taper in the medial direction M. In various embodiments, the sleeve can comprise an elastomeric rubber or other complaints material known in the art which is sufficient compliant to stretch over portions of hearing aid 20 and hold it in place by compression.

In various embodiments, all or a portion, of seal 100 can comprises a compliant material configured to conform to the shape of the ear canal. In many embodiments, the seal is fabricated from an elastomeric foam 100*f* having dimensions and compliance properties configured to conform to the shape of the ear canal and exert a spring force on the canal so as to hold the seal 100 in place in the ear canal. Foam 100*f* can be either open cell or closed cell as is known in the art. Suitable materials for foam 100*f* include polyurethanes, silicones, polyethylenes, flouropolymers and copolymers thereof. In a preferred embodiment, foam 100*f* is a polyurethane foam known in the art. Also in various embodiments, all or a portion of seal 100 can comprise a hydrophobic material known in the art including an hydrophobic layer or coating. Also the material while being hydrophobic, can be also be permeable to water vapor transmission. Examples of such material, include without limitation, silicones and flouro-polymers such as expanded polytetroflouroethylene (PTFE).

In various embodiments, seal 100 can include a core portion or core 101 and a skin portion (hereinafter "skin") or surface layer 102. The two portions can comprise different materials or the same material with different properties. In many embodiments, the skin can be substantially smooth and the core porous. Also in many embodiments, the skin is integral to the core portion. However, in alternative embodiments, the two can be separate layers with the skin affixed or coated onto the core. In a preferred embodiment, skin 102 comprises a substantially smooth non porous layer 102*n* that is integral to porous core portion 101. This and related embodiments, can be produced by a combination process of injection molding and casting of the seals using polymer processing methods known in the art.

Figure 5C:
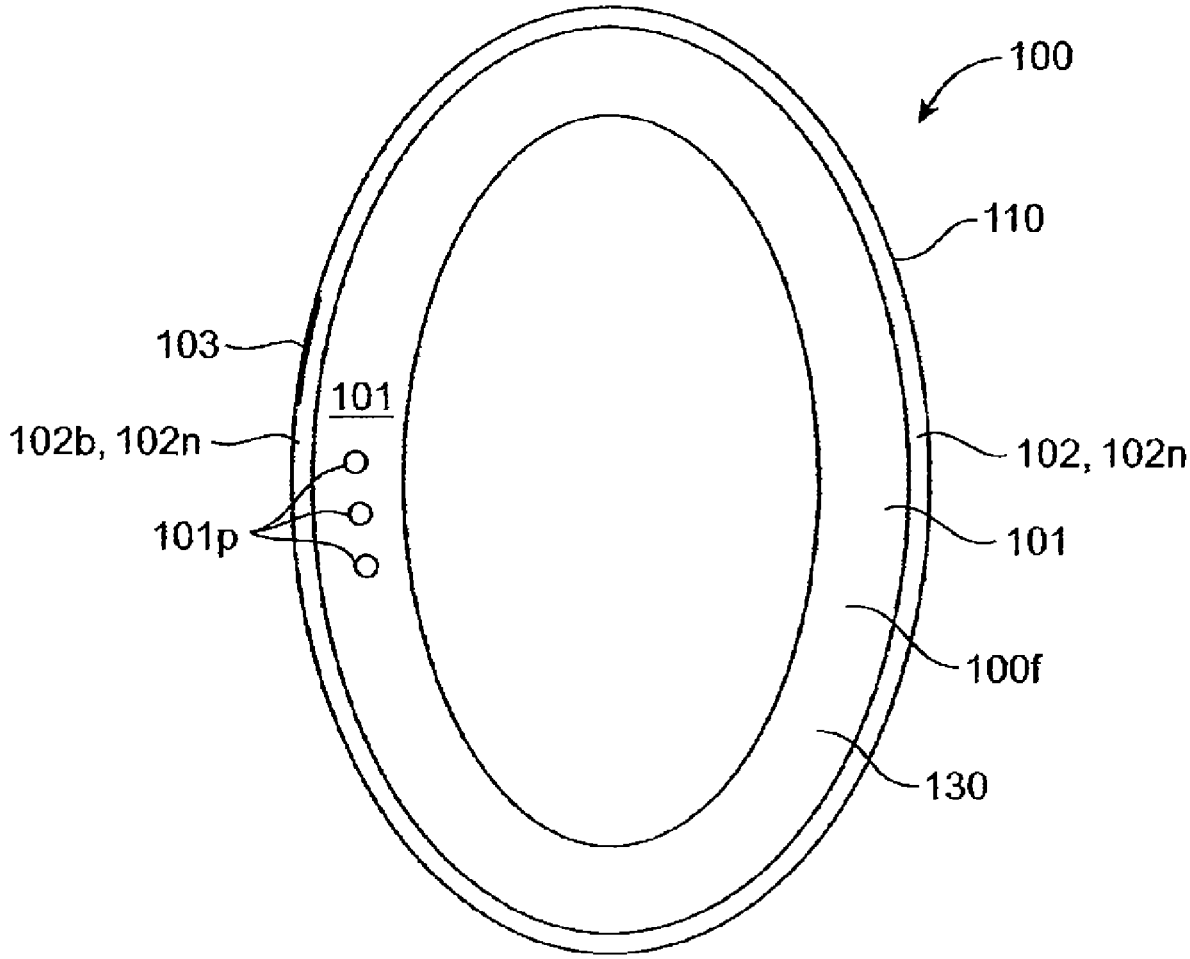
FIG. 5C is a cross sectional view illustrating the structure of the walls of an embodiment of the seal.

In various embodiments, layer 102 and layer 102*n* can be configured to perform several functions including one or more of the following: i) retention of the seal in the ear canal; ii) providing a biocompatible tissue contacting layer; iii) providing a barrier to liquid ingress; and iv) providing for the dimensional stability of the seal 100. In particular embodiments, layer 102*n* also serves to seal off the pores 101*p* of core portion 101 so as to form a sealed layer or barrier 102*b* to the influx of water and other liquids into seal 100 including core 101 as is shown in FIG. 5C. In particular, barrier 102*b* can be configured to have sufficient liquid barrier properties to substantially prevent seal 100 including core 101 from swelling after periods of extended wear due to the absorption or ingress of appreciable amounts of water over time. In this way, layer 102*b* serves to maintain the dimensional stability of seal 100 over periods of extended wear, e.g., three to six months or longer. The liquid barrier properties of layer 102*b* can be enhanced by the use of a hydrophobic coating 103. Suitable hydrophobic coatings include medical grade silicone coatings known in the art such as those available from the Dow® Chemical Corporation.

While barrier 102*b* serves as a liquid barrier, at the same time it can be configured to permit water vapor transmission though the barrier to allow water vapor to diffuse through the seal. For example, barrier 102*b* can be configured to prevent liquid water from entering the seal, but also allow water vapor on the medial side of the seal (e.g., due to sweat) to diffuse down gradient to the lateral side to allow the medial side to equilibrate with ambient humidity levels. This can be accomplished by configuring the barrier from waterproof, water vapor permeable materials. Such materials can include silicones, polyurethanes and hydrophobic micro-porous materials such as expanded PTFE. In this way, the liquid barrier and vapor transmission properties of barrier 102*b* serve to reduce the incidence of infection of ear canal 20 and seal 100 by reducing accumulated moisture levels within the seal and/or within the ear canal. The reduced incidence of infection in turn improves the long term wearability of a hearing aid using seal 100. Also as discussed below, the infection resistance of the coating can be improved through the use of anti-microbial agents incorporated into the coating. Use of such agents can combined with the aforementioned properties of barrier 102*b* to further improve the infection resistance of the coating and in effect, to provide a dual mode means of infection resistance.

In particular embodiments, barrier 102*b*, as well as shell walls 130 can be configured to have an in situ water vapor transmission rate of at least about 0.0010 gram/hour/cm$^2$ mmHg, and more preferably at least about 0.0015 gram/hour/cm$^2$ mmHg. These are the water vapor transmission rates when the seal is positioned in the ear canal of a wearer. The seal can also have a resistance to moisture vapor transmission of less than about 4 and more preferably less than about $3\times10^{12}$/m/sec with a specific embodiment of $2.8\times10^{12}$/m/sec. The permeance of the seal can be in the range of 50 to 250 grams/day/m$^2$/mmHg or greater with specific embodiments of about 50, 67, 70 100, 150, 200 or 225 grams/day/m$^2$/mmHg. Moisture vapor transmission rates, permeability and permeance can be measured using e.g., one or more of the methods described in Appendix 1, ASTM Standard E96, Standard Test Methods for Water Vapor Transmission of Materials and other tests known in the art. The entire shell can have a water vapor transmission rate of at least about $2.0\times10^{-3}$ grams/day mmHg, more preferably, at least about $3.0\times10^{-3}$ grams/day mmHg, and still more preferably at least about $4.0\times10^{-3}$ grams/day mmHg.

In various embodiments, the composition of the coating can include one or more antimicrobial agents so as to improve the infection resistance of the coating. Such agents can include silver oxide or other silver based compounds known in the art as well as one or more antibiotics. The coating can be formulated with an amount of antimicrobial agent effective to produce a selected log reduction in the colony forming units of bacteria contacting the seal, for example between a one to three log reduction or more. In a preferred embodiment, the coating is constituted with an amount of antimicrobial agent so as to produce at least about a two log reduction in colony forming units contacting the coating. Measurement of the log reduction in colony forming units of bacteria can be performed using various test methods including DOW CORNING Corporate Test Method 0923 "Antimicrobial Activity, Dynamic Test of Surfaces; Japanese Industrial Standard Test Method, Z 2801 and other microbiological assays known in the art. Such assays can be used to titrate the amount of antimicrobial, and/or antibiotic to produce the desired reduction in colony forming units contacting the surface of the coating. Other metrics for determining the antimicrobial activity of coating known in the are can also be employed alone or in combination with one of the assays described above. The amount of antimicrobial agent can be titrated depending upon the patient, e.g., for patients having a history of ear infections, the concentration of antibiotic in the coating can be increased or otherwise configured to elute off so as to maintain higher concentrations at the surface of the coating. Also, combinations of antimicrobial agent can be used for the ear infection prone patient.

In various embodiments, the antimicrobial agent can comprise an antibiotic or like medicament. Suitable antibiotics include without limitation, penicillin, cephalosporins, beta-lactams, aminoglycosides, glycopeptides, macrolides, streptogramins, tetracyclines, sulfa-based antibiotics and like compounds. Again, the amount of the selected antibiotic(s) can be configured to produce a desired reduction in the colony forming bacteria contacting the coating. In a preferred embodiment, the type and amount of antibiotic incorporated into the coating is configured to produce a least about a two log reduction in colony forming units of bacteria contacting the coating. Greater reductions can be selected using larger amounts (e.g., concentrations) of antibiotic within the coating. Various stabilizing agents and like compounds can also be included with the antibiotic. In one embodiment, a bacterial culture of the patients ear can be taken before positioning of the device to determine what type(s) of bacteria are present (e.g., staph. aureous.) and their associated antibiotic resistance and the antibiotic(s) used for the coating can be selected accordingly.

In various embodiments, the coating can be formulated so as to elute a desired amount of a selected anti-microbial agent(s) for a selected wear period, for example three to six months or longer. The rate of elution can be titrated to produce a surface concentration of the eluted anti-microbial compound to produce a desired log reduction of colony forming units of bacteria, for example a two log reduction or greater. The eluting coating can be formulated using eluting formulation methods known in the art, such as though used to formulate eluting vascular stents.

In various embodiments, the pharmacokinetics of elution can also be adjusted so as to have two or more rates of elution over time (i.e., multi rate elution) to achieve desired release rates and surface concentrations over particular periods of wear. For example, coating 103 or other coating can be configured to have an initial faster rate of elution for the several weeks followed by a slower rate for the remainder of the wear period of the hearing aid, e.g., three to six months or longer. This can be achieved by the use of concentration gradients of the anti-microbial agents within coating 103 or other coating, or through use of compounds having varying molecular weight or other chemical properties. In addition, elution rates can be controlled by controlling the thickness of the coating. For example, the coating can have a tapered thickness, which can be linear or curved to achieve a desired elution rate through diffusion/permeation or a related form of mass transfer.

Figure 8A:
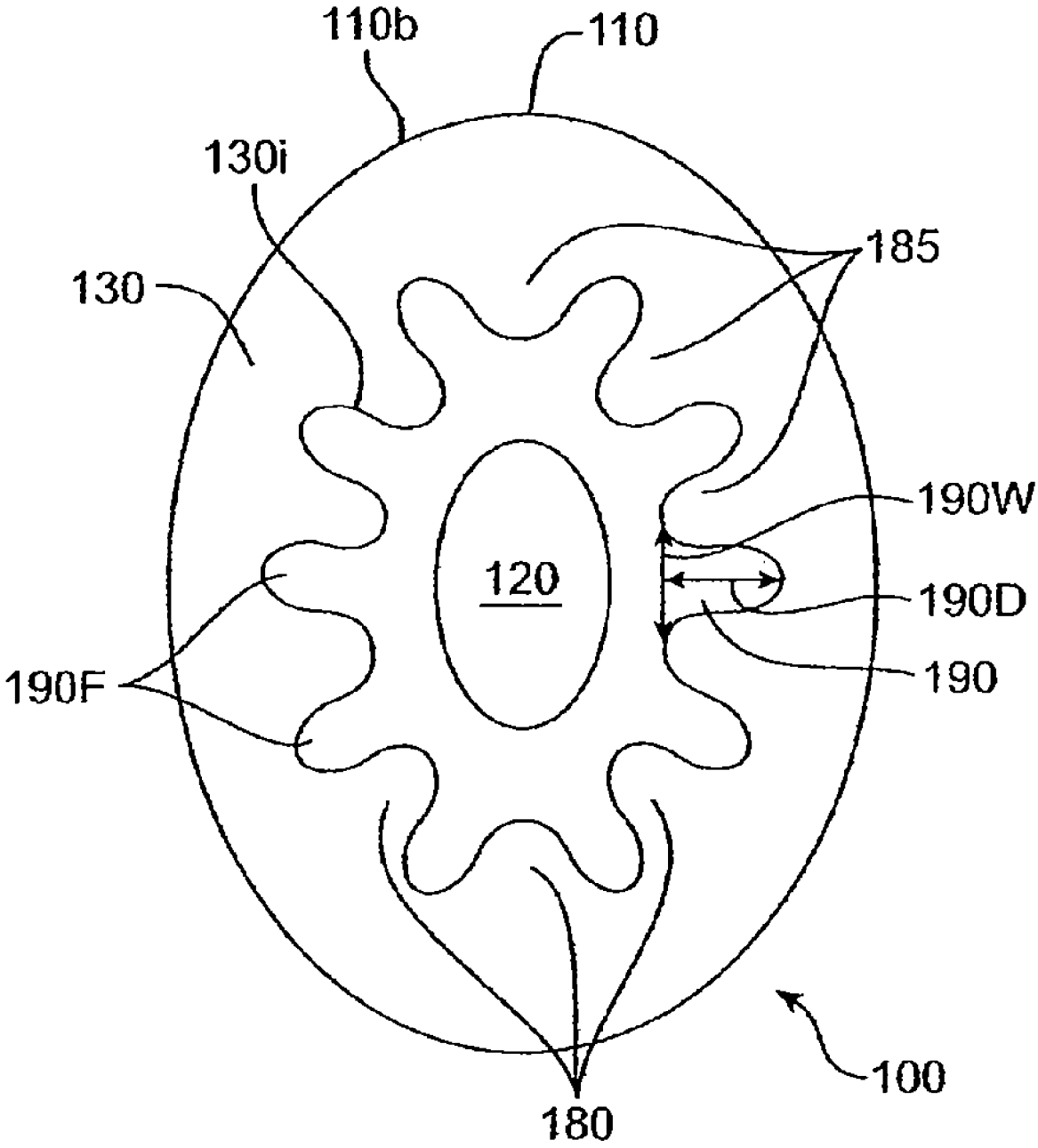
FIG. 8A is a bottom up cross sectional view showing an embodiment of the retainer having scalloped walls.
Figure 8B:
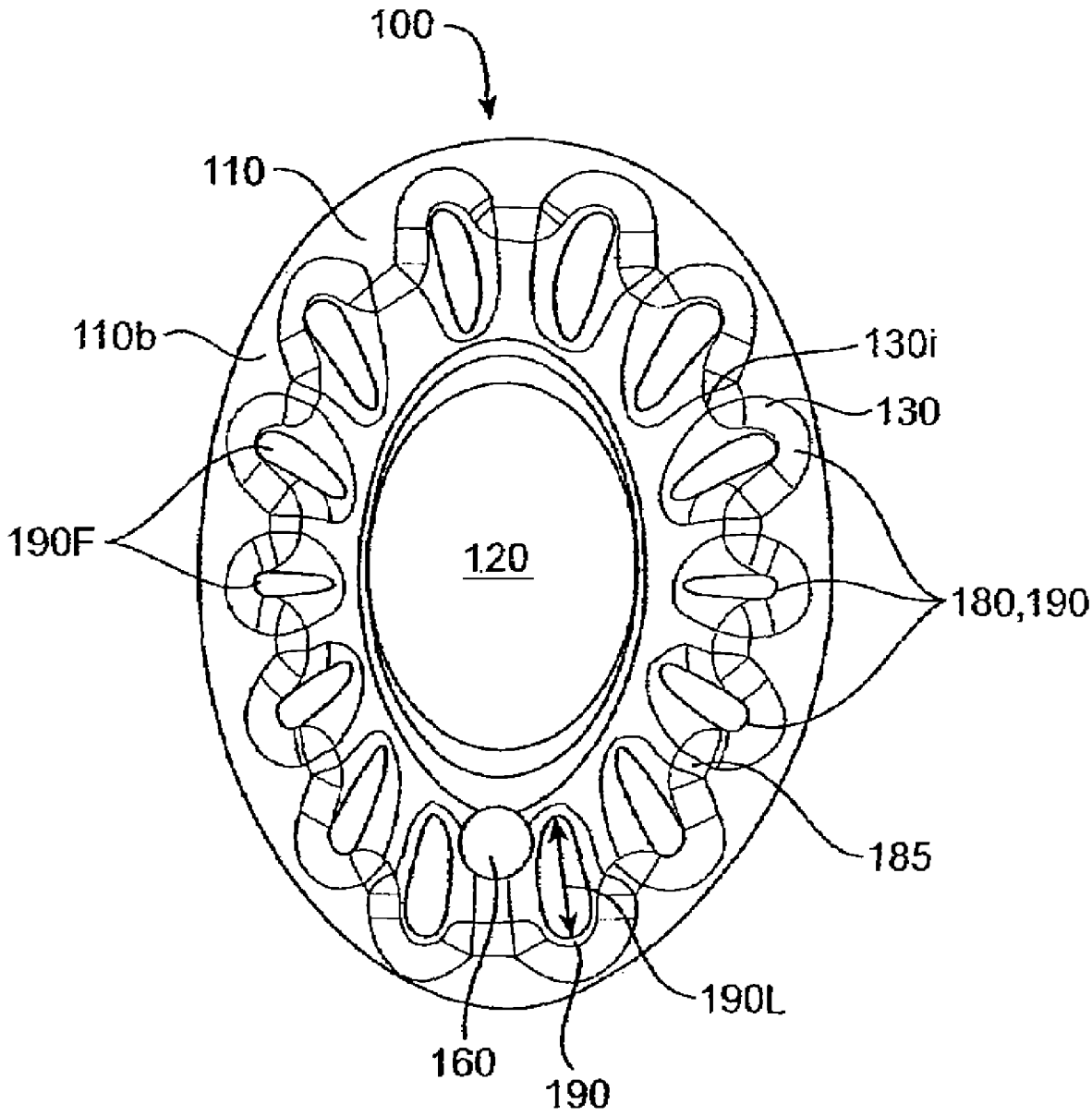
FIG. 8B is a bottom up view showing an embodiment of the retainer having scalloped walls that include a vent.
Figure 9:
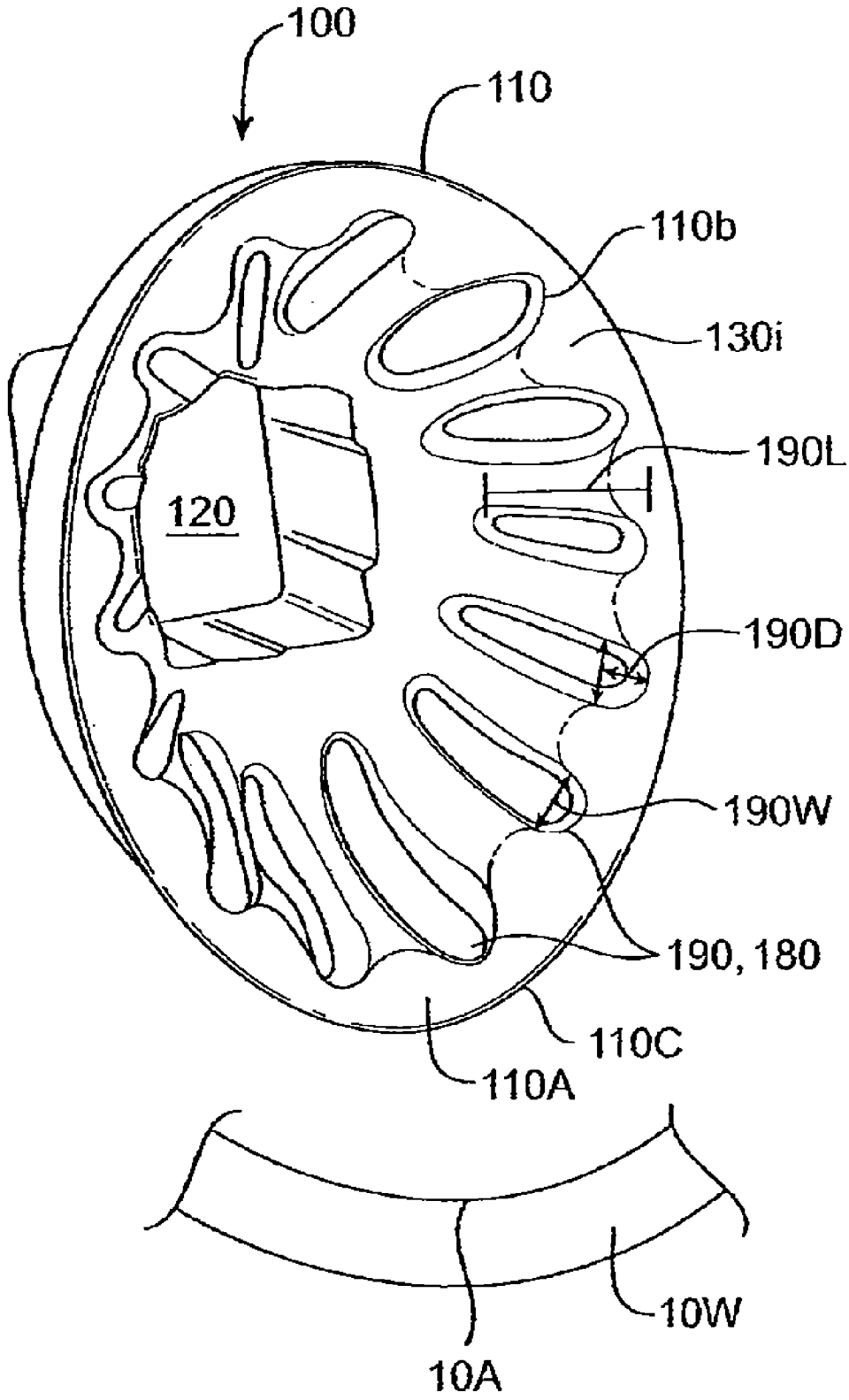
FIG. 9 is a perspective view of another embodiment of the retainer having scalloped walls.

Referring now to FIGS. 8A-8B and 9, in various embodiments, the inner portion 130*i* of wall 130 of shell 110 can include a scalloped or convoluted pattern or shape 180 having one or more scallops 190. The scallops can be configured to function as hinged elements 185 which collectively impart a selectable amount of stiffness and conformability to the walls of the seal as well as allowing a number of functions described below. The scallops can have a selectable depth 190D, length 190L width 190W and frequency or pitch 190F (i.e., number of scallops per unit length). These dimensions can be configured to impart to each scallop and/or hinge with a selectable stiffness. The length 190L can extend from opening 120 to the base of the shell 110*b* or a shorter distance. In particular embodiments, the scallops (or other pattern 180) can be configured to provide the seal with a radial stiffness to allow the seal to be radially deflected as much as 1 cm or more and still conform to the shape of the ear canal so as to maintain an acoustical seal with the canal walls. Thus in this way, the seal can dynamically conform to changes in the shape of the ear canal so as to maintain an acoustical seal with the canal walls. In use, this allows the seal to maintain the acoustical seal during various activities tending to cause canal deformation such as chewing, head movement, sports and like activities.

Example scallop patterns 180 are shown in FIGS. 8A-8B and 9. The scalloped patterns can be configured for embodiments of the seal having an oval or round opening 120 as is shown in FIGS. 8A and 8B or rectangular opening 120 as is shown in FIG. 9. Also the scalloped pattern can be configured for embodiments of the seal having a vent as is shown in FIG. 8B. In various embodiments, the number of scallops can range from about 5 to 20, more preferably 6 to 15 and the pitch can be in the range from about 0.010 to 0.060". In one embodiment, the pitch of the scallops can be about 0.030" with the seal having a total of 14 scallops. Also, the scallops can all have the same shape or a different shapes. For example, in one embodiment, the shape of the scallops can alternate every other scallop, with the scallops varying in one or more of length, depth or width. The varying shape of the scallops can be used to produce a circumferentially substantially uniform amount of deformation of the seal as well as a circumferentially substantially uniform application of spring force by the seal on the ear canal. For example, in one embodiment, this can be achieved by having different shaped scallops at the apex 110A of profile 110C corresponding to the apex 10A of the ear canal as is shown in FIG. 9. In various embodiments, the shape, pitch and number of scallops can be selected depending upon one or more of the following criteria: i) the shape and dimensions of the ear canal of an individual patient; ii) the shape, dimensions and material properties of the sealing retainer; iii) the shape and dimensions of the hearing aid; iv) whether one or two or more seals are used; and v) where the hearing aid is positioned in the ear canal e.g., the bony portion 13 vs. the cartilaginous portion 11.

Figure 10B:
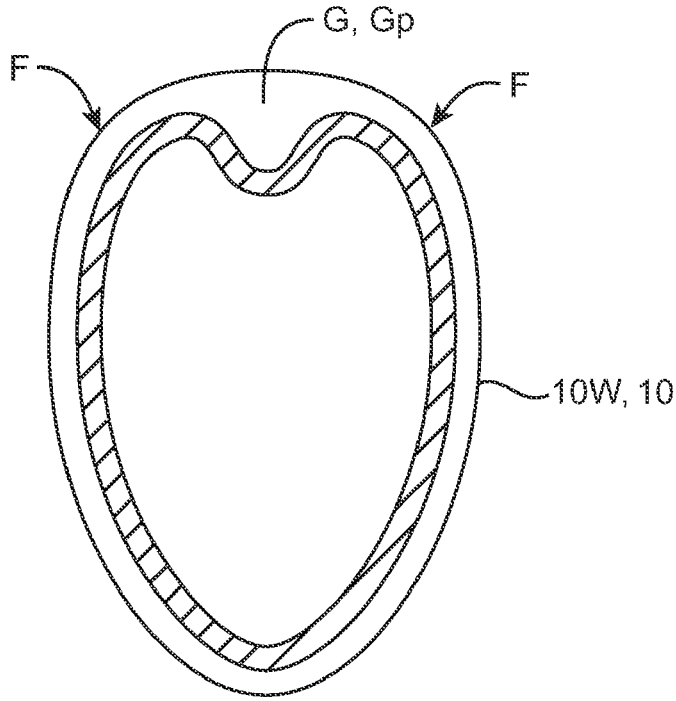
FIG. 10B is a cross-sectional view of an embodiment of the retainer without scalloped walls which illustrates development of a gap or buckling of the seal when positioned in the ear canal as result the application of compressive forces from the canal.
Figure 10A:
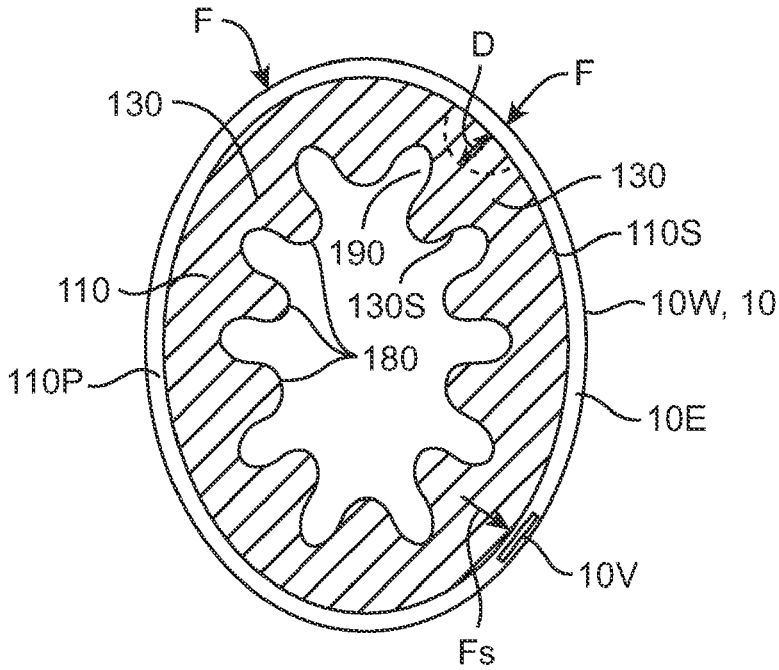
FIG. 10A is a cross-sectional view of an embodiment of the retainer having scalloped walls which illustrates the distribution/applications of compressive forces from the ear canal on the shell wall.

Referring now to FIGS. 10A and 10B, in various embodiments, scalloped pattern 180 can be configured to perform a number of functions. First pattern 180 can be configured to uniformly distribute compressive forces F applied by the ear canal to the shell surface 110S such that there is substantially continuous contact between the seal and the ear canal to prevent acoustical gaps. More specifically, pattern 180 can be configured to distribute the compressive forces F applied to the outer surface 110S of shell wall 130 by canal 10 such that the shell wall 130 does not appreciably deform to cause a gap G resulting in an acoustical leak between an the outer surface of the shell 110S and walls of the ear canal 10W as might occur without the scalloped patterns (See FIG. 10B). In specific embodiments, the scalloped pattern 180 is configured to prevent buckling of the seal including pleated deformation resulting in a pleated gap Gp. Also scalloped shape 180 can be configured to produce a substantially constant amount of inward deformation D of shell wall 130 independent of site of force application along shell perimeter 110P. This results in a more uniform seal between seal 100 and the ear canal.

By uniformly distributing force (e.g., around the perimeter of the seal), scalloped pattern 180 also serves to decrease the amount of deformation and/or compression of the seal in response to forces applied by the ear canal to the seal. This decreased deformation provides several benefits. First, it provides more room in the cavity 140 allowing for a larger space for hearing aid 20 as well as a gap G between the hearing aid 20 and the inner surface 130*s* of the shell walls 130. Providing a larger gap G in turn allows for better ventilation of the inside of the shell reducing moisture buildup as well as facilitating diffusion of air to the battery assembly (improving battery life for embodiments having metal air batteries) and to microphone assembly (improving acoustic performance).

The reduced amount of seal deformation provided by embodiments of the seal having scallops 190 also serves to improve the vapor transmission of the seal including water vapor transmission. The improvement in water vapor transmission is due to several factors. First, there is less reduction in the porosity of the seal walls due to compression of the shell walls. That is, because there is less compression/deformation of the seal, fewer channels or pores (not shown) of the seal walls become occluded as a result of deformation. Further, deformation in one scalloped portion of the seal does not appreciably affect the vapor transmission in another portion. Also, because the density of wall 130 is not increased as much as would be for larger amounts of deformation, the permeability of the wall is not reduced as much. Finally, the water vapor transmission of embodiments of the seal having scallops 190 is increased because the wall thickness 130W of the seal can be decreased. As discussed herein, improved water vapor transmission reduces the likelihood of moisture buildup in ear canal and so reduces the risk of infection due to such moisture. Specific embodiments of scalloped pattern 180 can be configured to maximize water vapor transmission by minimizing wall deformation and/or compression of the shell walls.

In addition to uniformly distributing the application of forces by the ear canal on the seal, the scallop pattern can also be configured to uniformly distribute the application of spring force Fs (e.g., normal) and resulting pressures exerted by the seal on the inner circumference of the ear canal. This results in a greater degree of comfort for the patient by preventing the concentration of force in particular locations in the canal which can cause pain or irritation to the wearer. The prevention of force concentration also reduces the development of skin irritation and/or ulceration at such locations as well as preventing degradation of the bony portion of the ear canal (i.e., lost bone mass) for devices positioned therein.

In various embodiments, the spring force applied by the seal to the walls of the canal can be titrated within a selected range to meet various performance criteria related to comfort, fit and acoustical attenuation. For example, the scallop pattern 180 can be configured such that the spring force Fs and resulting spring pressure exerted by the seal on the canal does not exceed thresholds associated with various physiological aspects of the health of the ear canal. (The spring pressure exerted by the seal on the canal walls being approximately analogous to a hydrostatic pressure). For example, the pressure of the seal can be configured to be below the capillary venous return pressure of the vasculature 10V of the canal epithelial layer 10E which can be about 12 to 15 mmHg. Similarly, the seal can be configured to exert a spring pressure below about 6 mmHg, this spring pressure is associated with perceptions of comfort by the wearer. In a specific embodiment, the seal can be configured to exert a spring pressure of about 2-3 to about 6 mmHg. To achieve these pressures, seal 100 is desirably configured to exert no more than about 4 to 5 grams and more preferably no more than about 1.2 grams of force on the ear canal for a 1 mm of deflection of the seal with a lower level of about 0.1 to 0.6 grams. As is discussed herein, these and related embodiments serve to facilitate the long term health of the ear canal by reducing or preventing tissue ulceration and/or necrosis of the canal epithelium due to occlusion of the vasculature of the epithelium and thus preserve the health and structural integrity of the epithelium in contact with the seal. In this way, the scalloped shape of the inner seal wall serves to improve one or more of the comfort, biocompatibility and wearability of an extended wear hearing device 20 retained by seal 100 in the bony portion of the ear canal.

At the lower end of the spring pressure threshold, the seal is desirably configured to exert at least about 2 to 3 mmHg of pressure so as to retain the seal and the hearing aid in the canal and maintain an acoustic seal with the canal walls. This lower limit can be adjusted depending upon the desired retaining force. In related embodiments, the seal can be configured to have a shape and composition such that the force that it exerts on the canal walls is substantially constant regardless of deflection. Such mechanical behavior can be characterized a seal having a box like stress-strain curve in which above some deflection limit (e.g., an elastic limit), the material deforms plastically and exerts substantially the same force for substantially all deflections past that limit. For small deflections, the seal behaves as a linear spring with increasing force for increased deflection. Such mechanical characteristics can be achieved through the selection of the materials and shape of the seal including scalloped pattern 180. For example, elastomeric materials having spring like behavior can be combined with those exhibiting plastic deformation and viscoelastic creep.

In many embodiments, the seal is configured to have a structure such that the force for removal of the seal from the ear canal is greater than that for its insertion. In these and related embodiments, shell 110 can have a shape 110*s* such the action of inserting the hearing aid with an attached seal into the canal bends the seal so as to reduce the radial force it exerts on the canal wall. This also keeps the friction force substantially constant. However, when the seal is pulled by its middle in a lateral direction to remove the hearing aid from the canal, the walls of the shell exert an increased force on the canal wall, causing the resulting friction forces to increase. The friction forces peak just before the shell walls buckle under compressive loading. This is analogous to a mechanical toggle, or to the action of an arch to support a compressive load. Such mechanical function can be achieved by configuring shell 110 to have an umbrella or cup like shape 110U with the apex 110A of the shell facing the medial direction of the ear canal for example as is shown in the embodiments FIGS. 6A and 6B. In these and related embodiments, the shell can be configured so as to be biased to bend inwardly during insertion, but resist outward bending up to a particular force threshold during removal before collapsing and thus function as a mechanical toggle 110M. Other shapes can also be used such as curves having a parabolic or hyperbolic shape. In use, these and related embodiments of the seal allow a hearing aid to be easily inserted to a selected location in the ear canal (e.g., the bony portion) and retained at that location for periods of extended wear (e.g., up to six months) with little or no movement due to one or more of epithelial migration, ambient pressure changes or head and neck motion. Further, such embodiments allow a hearing aid to be positioned and retained in the bony portion of the canal close to the tympanic membrane to minimize residual volume and thus occlusion effects. This allows for the minimization of occlusion effects over a period of extended wear of the hearing aid, e.g., up to six months or longer and in turn, facilitate maintenance of the sound quality over that period of extended wear.

Also the removal forces can be increased by configuring the shell to exert a selected spring force against the walls of the canal (e.g., that corresponding to 12 mmHg) such that normal forces exerted against the canal wall are the accumulation of both spring forces and compressive forces. The friction/removal forces can also be controlled by selection of the texture and/or coating of the shell exterior. For example, use of an adhesive coating 104 on the shell wall can increase the removal forces. In various embodiments, the shape, spring forces and frictional characteristics of the shell can be selected to achieve specific amounts of insertion and removal forces as well as ratios between the two (e.g., 1:2, 1:3, 1:5, 1:10).

Figure 11A:
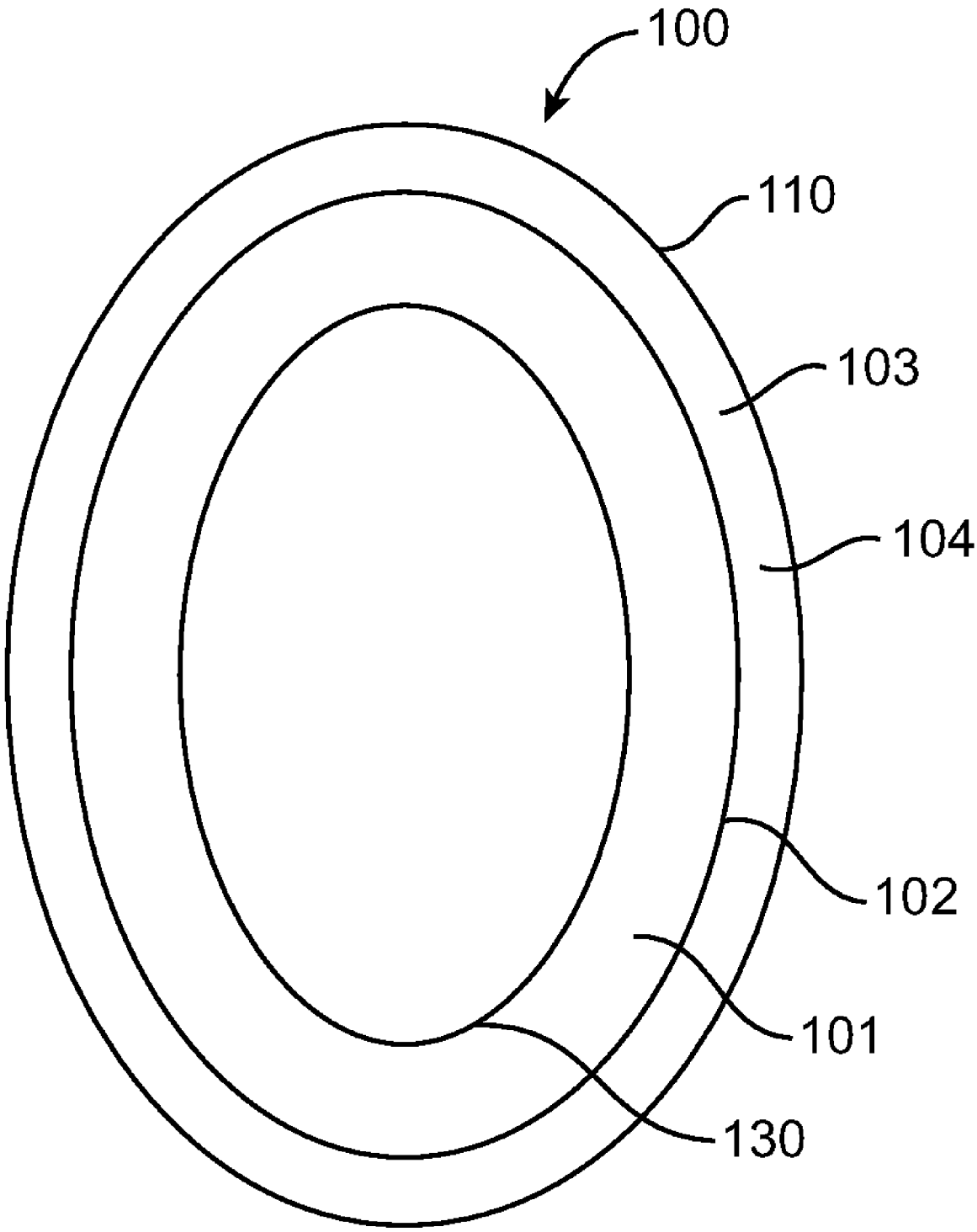
FIG. 11A is side view illustrating an embodiment of the seal having a coating.
Figure 11B:
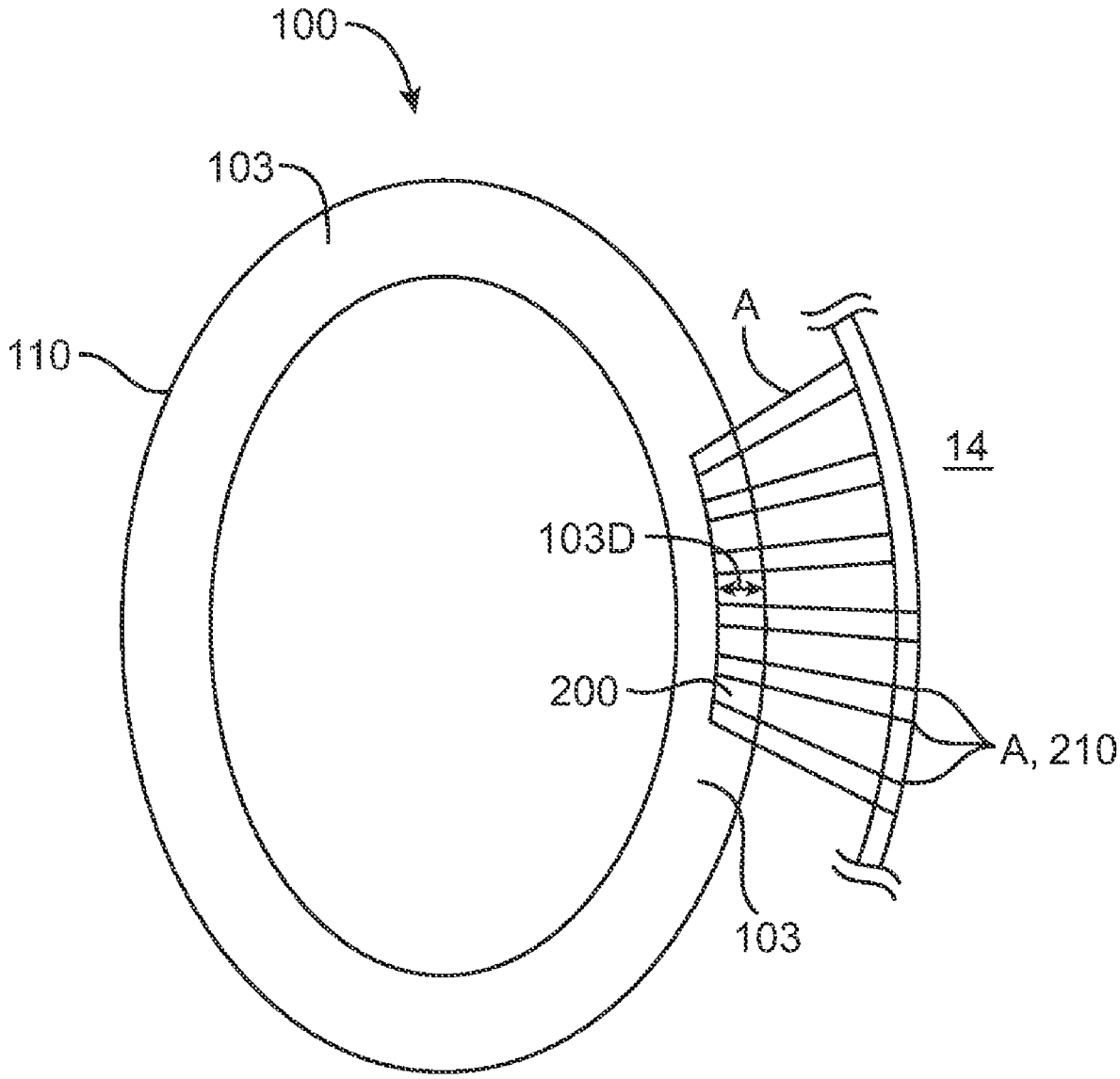
FIG. 11B is a side view illustrating in-growth of asparagines into coating of the seal.

Referring now to FIGS. 11A and 11B, in many embodiments, all or a portion of seal 100 can include a coating 103. Coating 103 can configured to facilitate or otherwise enhance retention of the seal in the ear canal as well as perform several other functions. The retention function of the coating can be accomplished by several means. First, coating 103 can be an adhesive coating 104 configured to adhere to the inner surface of the ear canal. Suitable adhesive coatings include biocompatible silicones adhesive coatings known in the art (e.g., silicone adhesives available from the General Electric Corporation). Such coatings can be configured to have a sufficient amount of adhesive force to retain the seal in the ear canal, but also be releasable to allow the user or physician to readily be able to remove the seal by hand and/or with the aid of an extraction tool.

Also the coating can be configured to promote the ingrowth of fibrils of endothelial tissue known as asparagines A to a selected depth 103D into the coating so as to mechanically retain the seal in the ear canal. Used in this way, coating 103 functions as a fastening surface 200 and asparagines A function as mechanical fastening elements 210. Together, these components function to fastenly retain seal 100 in the ear canal. In many embodiments, coating/surface 103 can be configured to retain the seal in the ear canal both through adhesive means (e.g., where the coating is an adhesive coating) and through mechanical fastening means. In this way, the use of coating 103 provides a dual means of retention of the seal in the ear canal for enhanced and thus more reliable retention of an extended wear hearing device in the ear canal.

In addition to performing a retention function, coating 103 can also be configured to have acoustical attenuation properties so as to increase the acoustical attenuation of the seal. In various embodiments, the coating can be configured to increase the acoustical attenuation of seal 100 in a range between about 1 to 10 decibels (in the audible frequency range), with specific embodiments of 3 and 5 decibels. Also, the coating can be configured to produce different amounts of acoustical attenuation by varying one or more of the viscosity/or filler components of the coating. For example, increased attenuation can be achieved by increasing the viscosity of the coating or increasing the concentration of particles within the coating. For silicone coatings, silica fillers can be used, or a silica free solution can be employed. Also, as described above, in particular embodiments the coating can be configured to fill in any pores or micro imperfections in the surface or core of the seal (initially present or that developing post-insertion) that may act as channels for acoustical leakage. In this way, the coating serves as an acoustical attenuation fault tolerance layer as well as a self repairing acoustical attenuating layer. Finally, the coating can also be a hydrophobic coating configured to provide or enhance the liquid sealing function of barrier 102*b* as described above to prevent vapor or liquid water from entering into and/or saturating the retaining seal.

Coating 103 also can be configured to provide both dimensional stability and structural integrity to the seal. This can be accomplished by i) configuring the seal to serve as a barrier to moisture and/vapor ingress as described above and ii) configuring the seal to have sufficient circumferential spring force (e.g., hoop elastic modulus) such that the seal material exerts a circumferential force that reduces or prevents seal core 100 from swelling radially or otherwise, for example due to saturation by water or other liquid. This latter property can be specifically achieved by configuring the coating such that the circumferential spring force of the coating exceeds any swelling forces of the seal core caused by saturation of the core from aqueous solutions. In various embodiments, the circumferential spring force of the seal can be between 0.05 to 0.25 lbs. The configuration of the coating to achieve such spring force can be achieved by selection of one or more of the thickness, elasticity, composition, viscosity and other viscoelastic properties of the coating. In essence, the coating acts as a retaining band or support that opposes any swelling forces of the seal core. This band or support function of the seal in turn, prevents or reduces the seal from swelling (e.g., in diameter or other dimension) as a result of saturation by water, sweat or other liquids in the ear canal. For use of polymeric coatings, such as silastic coatings, increased hoop modulus and/or hoop strength can be obtained by increasing the amount of the cross-linking of the coating (e.g., by thermal or other curing). Through the use of cross-linking, the hoop elastic modulus of the coating can be titrated for the needs of a particular wearer.

The coating can also be configured to provide structural stability to the seal core of the seal by acting as a structurally supporting and protective shell or skin. This shell provides mechanical support (e.g., by hoop strength) to the seal core as well as serving as a protective barrier to prevent degradation of the core by chemical environment in the ear canal (e.g., sweat, cerumen, etc). The protective function of the seal is particularly useful for embodiments of the comprising the seal comprising a foam core which can be degraded by the chemical environment within the ear canal due to ingress of liquid and other contaminants into the pores or cells of the foam. In this way, the coating provides a means for extending the life of the seal in the ear canal for periods of continuous extended wear, for example for periods of three to six months or longer without appreciable degradation in the function or structure of the seal. This in turn provides a seal which can be used for extended wear hearing device which can be worn for three to six months or longer.

Figure 12A:
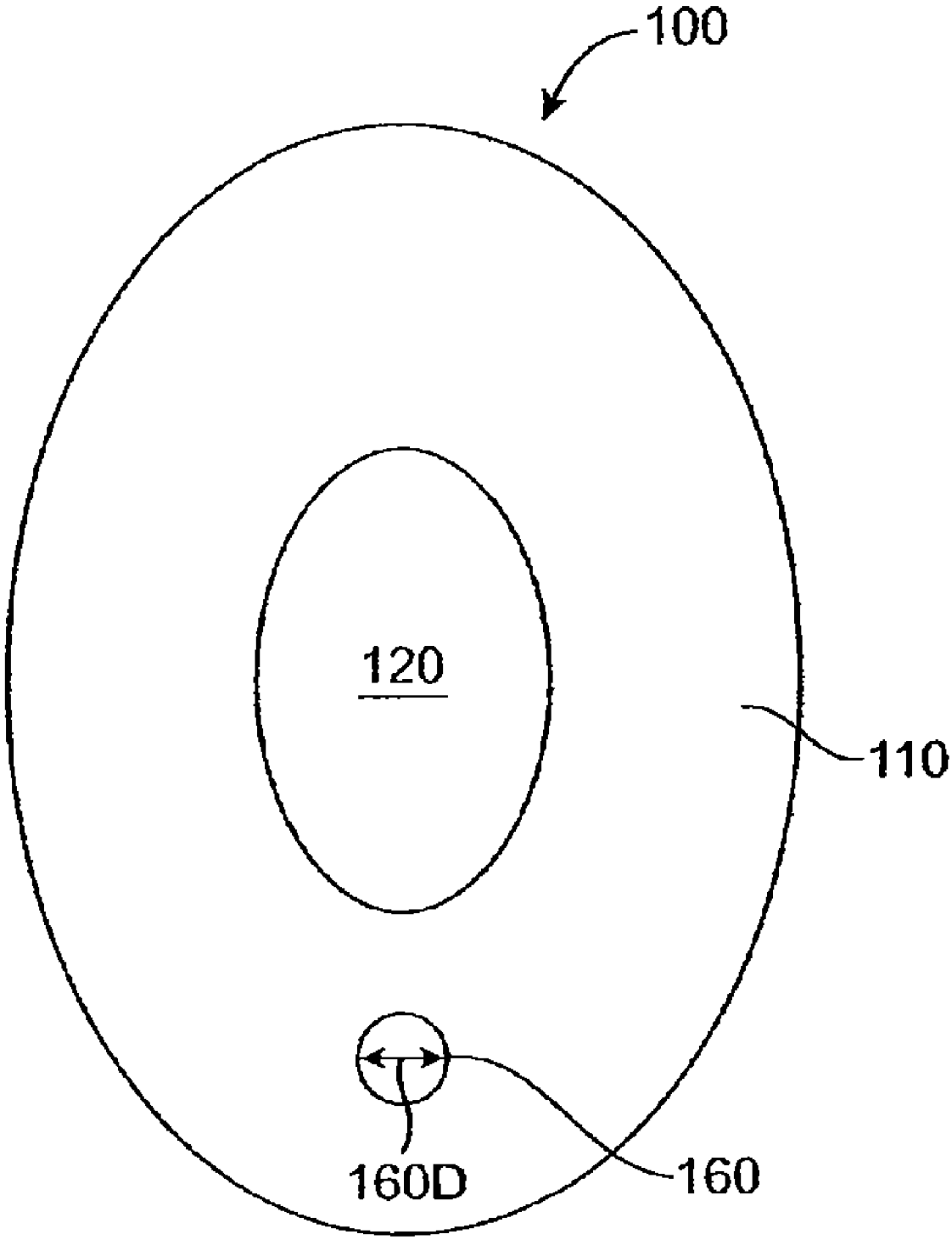
FIG. 12A is top down view showing an embodiment of the seal having a vent positioned close to the central opening.
Figure 12B:
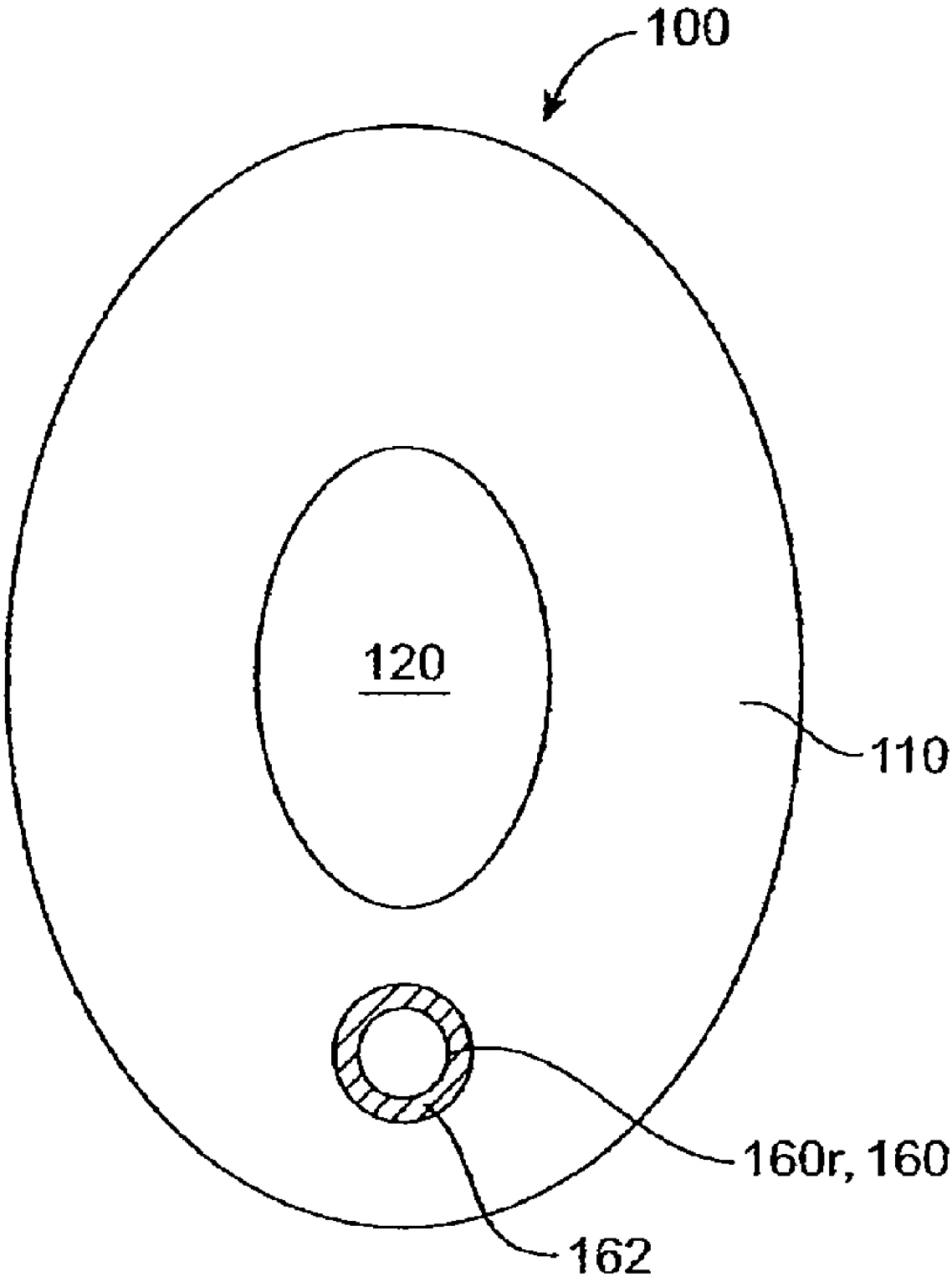
FIG. 12B is perspective view showing an embodiment of the seal having a recessed vent.

Referring now to FIGS. 12A-12B, in many embodiments seal 100 includes a vent 160 configured to allow the passage of air from portions of the canal medial to the seal to those portions lateral to the seal and vice a versa. Vent 160 is preferably positioned on the walls of shell 110 but can also be integral to opening 120 as describe herein. In a preferred embodiment, the vent is positioned on the shell walls close to opening 160. Vent 160 is desirably configured as a pressure relief device to provide rapid pressure equalization during insertion and removal of the hearing aid or during changes in atmospheric pressure. The vent can also allow for ventilation to the medial portions of the ear canal to prevent excessive moisture buildup during periods of extended wear. Additionally, the vent can also be configured as an occlusion relief vent to minimize occlusion effects. Also, the calibration algorithms of hearing aid 20 can be configured to account for the size and position of the vent on the seal to further reduce occlusion effects.

In various embodiments, vent 160 can have a circular, or square shape, which can be tapered inward or outward. Also, vent 160 and can be partially recessed within shell 110 to facilitate comfort to the user as is shown in FIG. 12B. In one embodiment, a recessed vent 160*r* can be configured using a lip or chamfer 162. In preferred embodiments, vent 160 has a circular shape. The diameter 160D of the vent can range from about 0.0001" to about 0.002." The diameter of the vent can also be configured to allow the passage of air for pressure equilibration but substantially inhibit the passage of liquid water and other fluids due to surface tension factors. In such embodiments, the diameter 160D can be between about 0.0001 to about 0.0008". Vent 160 can be formed by micromachining and/or laser drilling methods known in the art.

In alternative embodiments, vent 160 can include a valve (not shown) configured to regulate air entering and exiting the ear canal. The valve can be a micro-valve or MEMs-based devices known in the art. For embodiments having a MEMs-based valve, the valve electronics can be electronically coupled to and/or controlled by electrical components or module of the hearing aid 20, e.g., a processor of the microphone assembly 30. Such regulation equalizes pressure between the ear canal and an external ambient pressure while minimizing acoustical feedback. The valve can be formed as a flap on the sound port. The valve can also be formed as a hinged valve mounted within the sound port.

Conclusion

The foregoing description of various embodiments of the invention has been presented for purposes of illustration and description. It is not intended to limit the invention to the precise forms disclosed. Many modifications, variations and refinements will be apparent to practitioners skilled in the art. For example, embodiments of the protective seal can be used on a number of hearing devices including ITC devices. Further, the teachings of the invention have broad application in the hearing aid device field as well as other fields which will be recognized by practitioners skilled in the art. For example, various embodiments of seal materials and surfaces configured for asparagine in-growth are also applicable to the field of vascular prosthetics, including vascular grafts, where it is desirable to have tissue in-growth into the graft or other prosthetic in order to stabilize the graft and promote long term biocompatibility and reduced risk of infection. Other embodiments can be configured for use with other medical implants where it is desirable to have tissue in-growth to both stabilize the implant and promote long term biocompatibility. Such applications can include without limitation subcutaneous access ports (e.g., venous and arterial access); long term in dwelling catheters; implantable pumps (e.g., insulin pumps); implantable balloons (e.g., for treatment of aneurisms, gastrointestinal applications, etc.); implantable surgical fabrics, meshes and membranes (e.g., for tissue support and repair); and other like devices and materials.

Elements, characteristics, or acts from one embodiment can be readily recombined or substituted with one or more elements, characteristics or acts from other embodiments to form numerous additional embodiments within the scope of the invention. Moreover, elements that are shown or described as being combined with other elements, can, in various embodiments, exist as stand alone elements. Hence, the scope of the present invention is not limited to the specifics of the described embodiments, but is instead limited solely by the appended claims.

EXAMPLES

Various embodiments of the invention will now be further illustrated with reference to the following example. However, it will be appreciated that these examples are presented for purposes of illustration and the invention is not to be limited by this specific examples or the details therein.

Example 1

Measurement of Water Vapor Transmission

Measurement of water vapor transmission through embodiments of hearing device sealing retainer can be measured using a modified version of the ASTM E 96-95 standard method for measurement of water vapor transmission of a material. This method can be used to determine the water vapor transmission rate, permeability, permeance and resistance of the seal and hearing device. Water vapor transmission rate (WVTR), or transmission rate, is the quantity of water transmitted through a sample divided by the area of the sample and time and unit water vapor partial pressure. When multiplied by the area of sample, it can also be expressed as the quantify of water transmitted per unit time per unit, this later quantity is also known as flux. Permeance is the transmission rate divided by the water vapor partial pressure between two surfaces of the film. Permeability (often referred to as the permeability coefficient) is permeance times the thickness of the material. Resistance to water vapor transmission, or resistance is equal to the reciprocal of permeance times the area of the surface (e.g., 1/(Permeance*Area).

The ASTM E 96-95 method measures the water vapor transmission rate through a flat portion of a test assembly such as a hearing device, by placing it on top of a vial or tube filled nearly to the top with water. The assembly is weighed on a precision balance and then placed in a temperature and humidity controlled chamber for a set period of time. Weighing again after this interval allows computation of the amount of water that evaporated through the assembly. This calculation in turn is used to derive the material water vapor transmission rate. In particular instances, the method was used to determine the water vapor transmission rate through a hearing device positioned in a simulated ear canal. The hearing device tested had two seals comprising embodiments of those described herein. The above procedure was modified by placing a 20 mm cylinder atop a glass vial, where the bore of the cylinder was sized to the nominal ear canal perimeter targeted by the device's seals. The device was positioned in the cylinder such that the lateral end of the device was flush with the top of the cylinder. Variations in placement may be compensated for using a model based on Fick's law. The vapor outflow from the device positioned in the test cylinder was determined based on the change in weight of the test apparatus over a known period of time and used to calculate the water vapor transmission rates, water vapor permeance and/or resistance to water vapor transmission of the hearing device. These calculations assume minimal or no vapor transmission through the test cylinder and also assume that there is no leakage around the seals and that all of the vapor transmission through the hearing device occurs through the seals. Therefore, it is assumed that the values obtained also apply to the seals.

Using the above methods, tests were performed on polyurethane seals having silicone coatings with 6 and 29% solids respectively. Measurements of water vapor transmission rates from this method were then used to calculate permeance and resistance values of about 50 g/day/m$^2$/mmHg and $4.6\times10^{12}$/

(ms) respectively for the 29% solids solution and 67 grams/day/$m^2$/mmHg and $2.8\times10^{12}$/(ms) respectively for the 6% solids solution. These calculations assumed a temperature of the seal and surrounding area of approximately 35° C. with a 50% relative humidity and an elliptical seal having approximately a 61 mm cross sectional surface area (e.g., an ellipse having a 7.75 mm minor axis and a 10.0 mm major axis).

What is claimed is:

1. A seal for retaining a hearing device within a portion of the ear canal, the seal comprising:

a curved shell having a wall and an opening at an apex portion of the shell, the shell wall defining a cavity for retention of a hearing device component, at least a portion of the shell comprising a resilient material having sound attenuating properties;

wherein the shell wall is configured to distribute compressive forces applied to a shell perimeter such that when the shell is positioned in the ear canal, the shell wall dynamically conforms to changes in the shape of the ear canal to maintain an acoustical seal between an exterior surface of the shell and the walls of the ear canal, wherein the shell wall is configured such that a spring pressure exerted by the shell on the walls of the ear canal does not exceed the capillary venous return pressure of the vasculature of the epithelial layer of the ear canal.

2. The seal of claim 1, wherein the shell has a structure such that a force for removal of the seal from the ear canal is greater than a force for insertion of the seal into the canal.

3. The seal of claim 1, wherein the shell is sized to be positioned in the bony portion of the canal such that a residual volume in the canal is less than about 0.5 cc.

4. The seal of claim 1, wherein the shell wall has a shape configured to distribute the compressive forces to maintain the acoustical seal.

5. The seal of claim 1, wherein deformation in one portion of the shell wall does not appreciably effect a water vapor transmission rate in another portion.

6. The seal of claim 1, wherein the shell has an in situ water vapor transmission rate of at least about $3.0\times10^{-3}$ grams/day mmHg.

7. The seal of claim 1, wherein the shell has an in situ water vapor transmission rate of at least about $4.0\times10^{-3}$ grams/day mmHg.

8. The seal of claim 1, wherein the shell wall has an in situ water vapor permeance of at least about 50 grams/day/$m^2$/mmHg.

9. The seal of claim 1, wherein the shell wall has an in situ water vapor permeance of at least about 70 grams/day/$m^2$/mmHg.

10. The seal of claim 1, wherein the shell wall has an in situ water vapor permeance of at least about 100 grams/day/$m^2$/mmHg.

11. The seal of claim 1, wherein at least a portion of the seal includes an anti-microbial coating configured to produce about a three log reduction in colony forming units of bacteria contacting the coating.

12. The seal of claim 11, wherein the coating includes at least one of an anti-microbial agent, a silver based anti-microbial agent or an antibiotic.

13. The seal of claim 12, wherein the anti-microbial agent or antibiotic is configured to be eluted from the coating for an extended period of wear in the ear canal.

14. The seal of claim 13, wherein the period of extended wear is up to six months.

15. The seal of claim 1, wherein the seal is configured to achieve at least about three decibels of attenuation in sound in the audible frequency range between a medial and lateral portion of the shell when the shell is positioned in the ear canal.

16. The seal of claim 1, wherein the seal is configured to achieve at least about ten decibels of attenuation in sound in the audible frequency range between a medial and lateral portion of the shell when the shell is positioned in the ear canal.

17. The seal of claim 1, wherein the shell is configured such that a spring pressure exerted by the shell on the walls of the ear canal does not exceed about 12 mmHg.

18. The seal of claim 1, wherein the shell is configured such that a spring pressure exerted by the shell on the walls of the ear canal does not exceed about 6 mmHg.

19. The seal of claim 1, wherein the shell is configured such that a spring pressure exerted by the shell on the walls of the ear canal is in the range of about 2 to about 6 mmHg.

20. The seal of claim 1, wherein the shell has a stiffness configured to allow the shell to conform to the shape of the ear canal for a radial deformation of up to about 10 per cent of a diameter of the shell.

21. The seal of claim 1, wherein the shell has a stiffness configured to allow the shell to conform to the shape of the ear canal for a radial deformation of up to about 20 per cent of a diameter of the shell.

22. The seal of claim 1, wherein the shell wall has an in situ water vapor transmission rate configured to minimize an accumulation of moisture in the canal when the seal is in the canal for an extended period.

23. The seal of claim 1, wherein the shell wall has an in situ water vapor transmission rate configured to allow substantial equilibrium between a relative humidity in a bony portion of the ear canal when the seal is in the canal and a relative humidity of ambient air outside the ear.

24. The seal of claim 1, wherein the seal has an axial length in the range between about 5 to about 10 mms.

25. The seal of claim 1, wherein the seal is configured to be seated in a bony portion of the ear canal.

26. A CIC hearing aid for operation in a portion of an ear canal of a user, the hear aid comprising:

a microphone assembly;

a receiver assembly configured to supply acoustic signals received from the microphone assembly to a tympanic membrane of the user;

a battery assembly for powering the hearing aid, the battery assembly electrically coupled to at least one of the microphone assembly or the receiver assembly; and the seal of claim 1, wherein the seal is coupled to one of the battery assembly, the microphone assembly or the receiver assembly.

27. The hearing aid of claim 26, wherein the seal comprises a first seal and a second seal.

28. The hearing aid of claim 27, wherein the first and second seals are configured to be medially and laterally positioned with respect to a bend in the ear canal.

29. The hearing aid of claim 27, wherein the seals retain the receiver assembly and the battery assembly at an angular offset with respect to each other.

30. The hearing aid of claim 27, wherein the first seal is coupled to the receiver assembly and the second seal is coupled to the battery assembly or the microphone assembly.

31. The hearing aid of claim 30, wherein the first seal centers the receiver assembly at a first location in the ear canal and the second seal centers the microphone or battery assembly at a second location in the ear canal.

32. The hearing aid of claim 27, wherein the second seal augments the acoustical attenuation of the first seal.

33. The hearing aid of claim 26, wherein the hearing aid has a water vapor transmission rate configured to reduce an incidence of otitis of the ear canal.

34. The hearing aid of claim 26, wherein the hearing aid has an in situ water vapor transmission rate of at least about $2.0\times10^{-3}$ grams/day/mmHg.

35. The hearing aid of claim 26, wherein the hearing aid has an in situ water vapor transmission rate of at least about $4.0\times10^{-3}$ grams/day/mmHg.

36. A seal for retaining a hearing device within a portion of the ear canal, the seal comprising:

a curved shell having a wall and an opening at an apex portion of the shell, the shell wall defining a cavity for retention of a hearing device component, at least a portion of the shell comprising a resilient material having sound attenuating properties and at least a portion of the shell including an anti-microbial coating configured to produce at least about a three log reduction in colony forming units of bacteria contacting the coating;

wherein the shell wall is configured to distribute compressive forces applied to a shell perimeter such that when the shell is positioned in the ear canal, the shell wall dynamically conforms to changes in the shape of the ear canal to maintain an acoustical seal between an exterior surface of the shell and the walls of the ear canal, wherein the shell wall is configured such that a spring pressure exerted by the shell on the walls of the ear canal does not exceed the capillary venous return pressure of the vasculature of the epithelial layer of the ear canal.

37. A seal for retaining a hearing device within a portion of the ear canal, the seal comprising:

a curved shell having a wall and an opening at an apex portion of the shell, the shell wall defining a cavity for retention of a hearing device component, at least a portion of the shell comprising a resilient material having sound attenuating properties wherein the shell wall has an in situ water vapor permeance of at least about 50 grams/day/$m^2$/mmHg, wherein the shell wall is configured such that a spring pressure exerted by the shell on the walls of the ear canal does not exceed the capillary venous return pressure of the vasculature of the epithelial layer of the ear canal.

38. The seal of claim 37, wherein the shell wall has an in situ water vapor permeance of at least about 70 grams/day/$m^2$/mmHg.

39. A method for wearing a hearing device in the ear canal of a user, the method comprising:

providing a hearing device having a retaining seal configured to retain the device in the ear canal, the seal allowing a water vapor transmission rate between a portion of the ear canal medial to the hearing device and a portion lateral to the hearing device of at least about $2.0\times10^{-3}$ grams/day/mmHg;

positioning the hearing device at a location in the ear canal; and wearing the device in the canal on a substantially continuous basis while substantially preserving an integrity of an epithelial layer in contact with the seal.

40. The method of claim 39, wherein the water vapor transmission rate is at least about $4.0\times10^{-3}$ grams/day/mmHg.

41. The method of claim 39, wherein the seal comprises a first seal and a second seal.

42. The method of claim 39, wherein the device is worn continuously in the ear canal without substantial ulceration or necrosis of the epithelial layer.

43. The method of claim 39, wherein the device is worn for a period of up to about six months.

44. The method of claim 39, wherein the hearing device is worn in a bony portion of the ear canal.

45. The method of claim 39, wherein the seal allows a substantial equilibrium in humidity between a bony portion of the ear canal and an external portion of the ear.

46. A seal for retaining a hearing device within a portion of the ear canal, the seal comprising:

a curved shell having a wall and an opening at an apex portion of the shell, the shell wall defining a cavity for retention of a hearing device component, at least a portion of the shell comprising a resilient material having sound attenuating properties;

wherein the shell wall is configured to distribute compressive forces applied to a shell perimeter such that when the shell is positioned in the ear canal, the shell wall dynamically conforms to changes in the shape of the ear canal to maintain an acoustical seal between an exterior surface of the shell and the walls of the ear canal, and wherein the shell is configured such that a spring pressure exerted by the shell on the walls of the ear canal does not exceed about 12 mmHg.

47. The seal of claim 46, wherein the shell is configured such that a spring pressure exerted by the shell on the walls of the ear canal does not exceed about 6 mmHg.

48. The seal of claim 46, wherein the shell is configured such that a spring pressure exerted by the shell on the walls of the ear canal is in the range of about 2 to about 6 mmHg.

49. A CIC hearing aid for operation in a portion of an ear canal of a user, the hear aid comprising:

a microphone assembly;

a receiver assembly configured to supply acoustic signals received from the microphone assembly to a tympanic membrane of the user;

a battery assembly for powering the hearing aid, the battery assembly electrically coupled to at least one of the microphone assembly or the receiver assembly; and a seal for retaining a hearing device within a portion of the ear canal, the seal being coupled to one of the battery assembly, the microphone assembly or the receiver assembly, wherein the seal comprises:

a curved shell having a wall and an opening at an apex portion of the shell, the shell wall defining a cavity for retention of a hearing device component, at least a portion of the shell comprising a resilient material having sound attenuating properties;

wherein the shell wall is configured to distribute compressive forces applied to a shell perimeter such that when the shell is positioned in the ear canal, the shell wall dynamically conforms to changes in the shape of the ear canal to maintain an acoustical seal between an exterior surface of the shell and the walls of the ear canal, and wherein the seal comprises a first seal and a second seal.

50. The hearing aid of claim 49, wherein the first and second seals are configured to be medially and laterally positioned with respect to a bend in the ear canal.

51. The hearing aid of claim 49, wherein the seals retain the receiver assembly and the battery assembly at an angular offset with respect to each other.

52. The hearing aid of claim 49, wherein the first seal is coupled to the receiver assembly and the second seal is coupled to the battery assembly or the microphone assembly.

53. The hearing aid of claim 52, wherein the first seal centers the receiver assembly at a first location in the ear canal and the second seal centers the microphone or battery assembly at a second location in the ear canal.

54. The hearing aid of claim 49, wherein the second seal augments the acoustical attenuation of the first seal.

55. A CIC hearing aid for operation in a portion of an ear canal of a user, the hear aid comprising:

a microphone assembly;

a receiver assembly configured to supply acoustic signals received from the microphone assembly to a tympanic membrane of the user;

a battery assembly for powering the hearing aid, the battery assembly electrically coupled to at least one of the microphone assembly or the receiver assembly; and a seal for retaining a hearing device within a portion of the ear canal, the seal being coupled to one of the battery assembly, the microphone assembly or the receiver assembly, wherein the seal comprises:

a curved shell having a wall and an opening at an apex portion of the shell, the shell wall defining a cavity for retention of a hearing device component, at least a portion of the shell comprising a resilient material having sound attenuating properties;

wherein the shell wall is configured to distribute compressive forces applied to a shell perimeter such that when the shell is positioned in the ear canal, the shell wall dynamically conforms to changes in the shape of the ear canal to maintain an acoustical seal between an exterior surface of the shell and the walls of the ear canal, and wherein the hearing aid has a water vapor transmission rate configured to reduce an incidence of otitis of the ear canal.

56. The hearing aid of claim 55, wherein the in situ water vapor transmission rate is at least about $2.0\times10^{-3}$ grams/day/mmHg.

57. The hearing aid of claim 55, wherein the in situ water vapor transmission rate is at least about $4.0\times10^{-3}$ grams/day/mmHg.

* * * * *